US006056385A

United States Patent [19]

Tamura

[11] Patent Number: 6,056,385

[45] **Date of Patent: *May 2, 2000**

[54] METHOD OF OPERATING AND AN APPARATUS USING AN INK JET RECORDING HEAD HAVING SERIALLY CONNECTED ENERGY GENERATING MEANS

[75] Inventor: Yasuyuki Tamura, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/521,330

[22] Filed: Aug. 30, 1995

Related U.S. Application Data

[62] Division of application No. 08/166,905, Dec. 15, 1993, Pat. No. 5,477,243, which is a continuation of application No. 07/659,701, Feb. 25, 1991, abandoned.

[30] Foreign Application Priority Data

Feb. 26, 1990 [JP] Japan ..... 2-042658

[51] Int. Cl.[7] ..... B41J 29/38; B41J 2/145; B41J 2/05

[52] U.S. Cl. ..... 347/12; 347/13; 347/57

[58] Field of Search ..... 347/12, 13, 180, 347/181, 182, 11, 57; B41J 2/05

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/56 |
| 4,353,079 | 10/1982 | Kawanabe | 347/11 |
| 4,424,520 | 1/1984 | Matsuda et al. | 347/11 |
| 4,459,600 | 7/1984 | Sato et al. | 347/56 |
| 4,463,359 | 7/1984 | Ayata et al. | 347/56 |
| 4,558,333 | 12/1985 | Sugitani et al. | 347/65 |
| 4,577,201 | 3/1986 | Murakami et al. | 347/68 |
| 4,596,995 | 6/1986 | Yamakawa et al. | 347/13 |
| 4,623,899 | 11/1986 | Sakakibara | 347/182 |
| 4,723,129 | 2/1988 | Endo et al. | 347/56 |
| 4,740,796 | 4/1988 | Endo et al. | 347/56 |
| 5,172,130 | 12/1992 | Takahashi | 347/13 |
| 5,173,717 | 12/1992 | Kishida et al. | 347/13 |
| 5,477,243 | 12/1995 | Tamura | 347/12 |

FOREIGN PATENT DOCUMENTS

| | | |
|---|---|---|
| 49-105544 | 10/1974 | Japan . |
| 51-094940 | 8/1976 | Japan . |
| 58-203062 | 11/1983 | Japan . |
| 62-290557 | 12/1987 | Japan . |
| 63-278858 | 11/1988 | Japan . |
| 64-038245 | 2/1989 | Japan . |

*Primary Examiner*—N. Le
*Assistant Examiner*—Thinh Nguyen
*Attorney, Agent, or Firm*—Fitzpatrick, Cella, Harper & Scinto

[57] ABSTRACT

An ink jet recording head has an energy generating device line constituted by electrically connecting N (N>1) energy generating devices in series. The energy generating devices are disposed to correspond to a plurality of discharge ports for discharging ink and generate discharging energy. The energy generating device line is operated by using substantially N+1 electrodes. The method of operating an ink-jet recording head comprises the steps of: successively selecting the energy generating devices of the energy generating device line; applying voltages of different levels to the two terminals of the selected energy generating device having received an image signal instructing the selected energy generating device to discharge the ink; and applying voltages of the same level to the two ends of the energy generating device which corresponds to the discharge ports which are not to discharge the ink.

8 Claims, 12 Drawing Sheets

IMAGE SIGNAL 1
CLOCK SIGNAL
LOAD SIGNAL
"H"
ST
LD
CK
P1
P2
P3
P4
PN-2
PN-1
PN
PN+1
PN+2
PN+3
PN+4
P2N-3
P2N-2
P2N-1
Q1
Q2
Q3
Q4
QN-2
QN-1
QN
QN+1
QN+2
QN+3
QN+4
Q2N-3
Q2N-2
Q2N-1
6
7
8
3
4
20
51
52
53
54
5N-2
5N-1
5N
5N+1
5N+2
5N+3
5N+4
52N-3
52N-2
52N-1
21
22
23
24
2N-2
2N-1
2N
2N+1
2N+2
2N+3
2N+4
22N-3
22N-2
22N-1
22N
11
12
13
14
15
1N-2
1N-1
1N
1N+1
1N+2
1N+3
1N+4
1N+5
12N-3
12N-2
12N-1
12N
HEAT EMITTING ELEMENT GROUP A
HEAT EMITTING ELEMENT GROUP B
IMAGE SIGNAL 2

IMAGE SIGNAL 1
CLOCK SIGNAL
LOAD SIGNAL
37
33
34
38
36
ST
LD
CK
P1
P2
P3
P4
PN-2
PN-1
PN
PN+1
PN+2
PN+3
PN+4
P2N-3
P2N-2
P2N-1
Q1
Q2
Q3
Q4
QN-2
QN-1
QN
QN+1
QN+2
QN+3
QN+4
Q2N-3
Q2N-2
Q2N-1
320
321
322
323
324
32N-2
32N-1
32N
32N+1
32N+2
32N+3
32N+4
32 2N-3
32 2N-2
32 2N-1
32 2N
351
352
353
354
35N-2
35N-1
35N
35N+1
35N+2
35N+3
35N+4
35 2N-3
35 2N-2
35 2N-1
391
392
393
394
395
39N-1
39N
39N+1
39N+2
39N+3
39N+4
39N+5
39 2N-2
39 2N-1
39 2N
39 2N+1
311
312
313
314
315
31N-2
31N-1
31N
31N+1
31N+2
31N+3
31N+4
31N+5
31 2N-1
31 2N-2
31 2N-1
31 2N
HEAT EMITTING ELEMENT GROUP A
HEAT EMITTING ELEMENT GROUP B
IMAGE SIGNAL 2
HIGH FREQUENCY PULSE SIGNAL

METHOD OF OPERATING AND AN APPARATUS USING AN INK JET RECORDING HEAD HAVING SERIALLY CONNECTED ENERGY GENERATING MEANS

This application is a division of Application Ser. No. 08/166,905 filed Dec. 15, 1993, now U.S. Pat. No. 5,477,243, which is a continuation of Application Ser. No. 07/659,701 filed Feb. 25, 1991, abandoned.

BACKGROUND OF THE INVENTION

1. Field of the Invention

The present invention relates to a method of operating an ink jet recording head. More particularly, the present invention relates to a method of operating an ink jet recording head arranged in such a manner that energy generating bodies for discharging ink are connected to one another in series.

2. Related Background Art

Hitherto, a so-called thermal ink jet recording head (referred to as an "ink jet recording head" hereinafter) for discharging ink by heating reveals an advantage in that a multiplicity of nozzles can integrally be constituted since the structure of each nozzle can be simplified and the size of the same can be reduced. Therefore, a plurality of nozzles have been integrally formed so as to be used in a printer for obtaining a high density record at high speed.

An ink jet recording head of the type described above must quickly operate its electrothermal converting body (also called a "heat emitting element" hereinafter), which serves as an energy generating means for generating ink discharging energy, in a short time for the purpose of effectively discharging ink. In general, the heat emitting element is operated by a short electric current pulse of several microseconds. Therefore, a large electric current flows at the time the heat emitting element commences operation. As a result, if a plurality of heat emitting elements are connected to one another with fine common wiring patterns, a voltage drop will take place in the common wirings. Therefore, a problem arises in that the operating conditions can undesirably vary in accordance with the number of the heat emitting elements which are operated simultaneously.

Accordingly, the following structures capable of overcoming the above-described problem have been known.

(1) Two wiring patterns through which positive and negative electric currents flow are provided for each of the heat emitting elements provided in the ink jet recording head. Furthermore, a protection layer made of a protecting material is provided so that the wiring patterns and the heat emitting elements are protected from the damage due to the electrochemical reaction.

(2) As disclosed in Japanese Patent Laid-Open No. 64-38245, when the heat emitting elements are operated, the signal for operating the heat emitting elements is divided into a plurality of pulse signals having a positive or negative potential with respect to a reference potential applied to the common electrode of the heat emitting elements. The thus divided pulse signals are applied to the selected electrode of the heat emitting element to be operated.

(3) As disclosed in U.S. Pat. No. 4,463,359, a plurality of heat emitting elements, which are disposed in a zigzag manner, are operated via a diode matrix. A method of operating the thus disposed heat emitting elements has been disclosed in Japanese Patent Laid-Open 49-105544 and 51-94940 in which the plurality of the heat emitting elements are divided into two blocks, predetermined heat emitting elements being alternately or simultaneously operated for each block.

(4) A structure has been disclosed in Japanese Patent Laid-Open No. 62-290557 by the applicant of the present invention in which, in a thermosensitive recording head, wirings of the number which is larger, by one, than the number of the plurality of heat emitting elements provided for the thermal head are used to establish the connections between the heat emitting elements and the operating portion to operate the heat emitting elements. Furthermore, the direction in which the operating current flows in the heat emitting element is not constant during operation.

However, the above-described conventional structures encounter the following problems.

(1) In the case where the two wiring patterns are provided for each of the heat emitting elements, wiring patterns numbering twice the number of the heat emitting elements must be provided. Therefore, the discharge ports cannot be easily mounted at a high density on the substrate of the ink jet recording head. Therefore, a critical problem arises when a precise image is desired.

If the heat emitting elements are formed at a high density, the thickness of each of the wiring patterns must be reduced because the number of the heat emitting elements is increased. This leads to the fact that electric resistance at the wiring pattern is excessively enlarged, causing the heating value to be enlarged excessively. As a result, the temperature at the inside portion of the ink jet recording head is raised excessively.

The thickness of the protection layer for protecting the wiring pattern and the heat emitting elements must be formed sufficiently large. However, the existence of even an extremely small pinhole will cause corrosion of a thin wiring pattern or the heat emitting elements to take place. The corrosion occurs because a positive or negative potential is repeatedly applied to that point in accordance with the potential applied to the two wiring patterns. As a result, the ink jet recording head will be broken. If the thickness of the protection layer is enlarged in order to strengthen the protection layer, heat generated in the heat emitting element cannot be easily transmitted to the ink. In consequence, a critical problem arises when a large ink-discharging force is desired. Therefore, ink cannot be discharged when the ink used has a high viscosity or the components of the ink have been changed due to evaporation or the like.

(2) The structure disclosed in Japanese Patent Laid-Open No. 64-38245 is capable of preventing the breakage of the ink jet recording head due to the above-described electrochemical reaction since a positive or negative pulse is applied to the selected electrode. However, the problem of the voltage dropping due to the enlargement of the electric resistance at the wiring pattern and the resulted problem of the heating value in the ink jet recording head cannot be overcome. Furthermore, since the positive and negative pulses are generated as the operating signals, a plurality of operating power sources must be provided, thereby causing the size of the apparatus to be enlarged excessively and the structure to become too complicated.

(3) In the case of the structure disclosed in U.S. Pat. No. 4,463,359, in which the heat emitting elements disposed in a zigzag manner are operated via the diode matrix, the existence of the diode matrix will restrict the direction in which the operating voltage is applied to the heat emitting element or the direction in which the operating current flows. Therefore, the problem arises in that the wiring patterns and the heat emitting elements become corroded. What is worse, the specific crosstalk of the diode matrix will cause heat emitting elements other than the specified heat emitting elements to generate heat. As a result, the heating value in the ink jet recording head can be increased and the operation of the heating elements may become unstable.

Furthermore, according to this operating method, the plurality of the heat emitting elements are divided into two blocks. In this case, the ink discharging timing is different for each of the blocks. As a result, when the ink jet recording head is relatively moved with respect to the recording medium so as to perform recording, the position at which ink adheres is deviated in the direction in which the ink jet recording head moves. As a result, the quality of the recorded image deteriorates.

(4) In a case where the operating method for use in the thermal head disclosed in Japanese Patent Laid-Open No. 62-290557 is employed in an ink jet recording head which records data by utilizing heat, a relatively large current flows in the heat emitting element of the ink jet recording head. Therefore, a problem arises in that the electric current flowing in the wiring pattern which connects the heat emitting element to the operating portion cannot be made constant. As a result, the voltage drop, which takes place in the wiring pattern will sometimes change. Therefore, the operating conditions for the heat emitting element cannot be stabilized. Furthermore, when the heat emitting element of an ink jet recording head which utilizes heat is operated at a repeated frequency of several KHz, it is preferable to supply electricity to the heat emitting element for several microseconds up to 10 $\mu$sec. The electric current, which instantaneously flows during that time so as to obtain the energy to discharge ink, is enlarged.

Therefore, when the method of operating the thermal head is employed, the selection operations for all of the heat emitting elements must be performed simultaneously and the selected heat emitting elements must be operated simultaneously. Therefore, the instantaneous current becomes too large, causing the heating value of the ink jet recording head to be enlarged excessively. Furthermore, the discharging operation becomes unstable.

(5) In the conventional ink jet recording apparatus, the ink jet recording head is operated in response to the image signal in such a manner that the image signal supplied as serial data is converted into parallel data by using a shift register so that the heat elements of the nozzles (ink passages) are operated to discharge ink. Therefore, the time width of the image signal cannot be changed individually from the selecting operation of the heat emitting elements. As a result, the heating value of the heat emitting elements cannot be controlled individually.

SUMMARY OF THE INVENTION

Accordingly, an object of the present invention is to provide a method of operating an ink jet recording head and a recording apparatus using the same, which are capable of both lengthening the life of the ink jet recording head and recording data precisely at high speed.

In order to achieve the above-described object, an aspect of the present invention lies in a method of operating an ink jet recording head having an energy generating means group constituted by electrically connecting N (N>1) energy generating means in series. The energy generating means correspond to a plurality of discharge ports for discharging ink by generating discharging energy. The energy generating means group is operated by N+1 wiring electrodes. The method of operating the ink jet recording head comprises the steps of: successively selecting the energy generating means of the energy generating means group; applying voltages of different levels to the two ends of the selected energy generating means which has received an image signal to discharge the ink, and applying voltages of the same level to the two ends of the energy generating means which are not receiving an image signal.

Another aspect of the present invention lies in a recording apparatus having an energy generating means group constituted by electrically connecting N (N>1) energy generating means in series. The energy generating means correspond to a plurality of discharge ports for discharging ink to a recording medium by generating discharging energy. The energy generating means group is operated by using substantially N+1 wiring electrodes. An ink jet recording head has the substantially N+1 wiring electrodes for operating the energy generating means group. The recording apparatus further comprises: a control means for successively selecting the energy generating means of the energy generating means group and, when the selected energy generating means receives an image signal which instructs the selected energy generating means to discharge the ink, applying voltages of different levels to the two ends of the selected energy generating means which has received the image signal. The control means also applies voltages of the same level to the two ends of the energy generating means which are not receiving an image signal.

Other and further objects, features and advantages of the invention will be appear more fully from the following description.

DESCRIPTION OF THE PREFERRED EMBODIMENTS

A preferred recording head for use in a discharge operating method for an ink jet recording head is arranged in such a manner that N energy-generating means are provided for the ink jet recording head, the N energy-generating means are connected to form groups or lines. Furthermore, N+1 wiring electrodes are connected to the energy generating means groups or lines. The above-described structure is operated in such a manner that the energy generating means are selected at predetermined intervals via the above-described wiring electrodes. When an image signal is supplied to a nozzle which corresponds to the selected energy generating means, voltages of different levels are applied to the wiring electrodes at the two end portions of the electrothermal converting bodies to produce an operating current for energization. As described above, since the image signal does not relate to the operation for selecting the electrothermal converting body to be operated, the width of the image signal, that is, the period in which the electrothermal converting body is operated can be optionally determined during the period in which a desired electrothermal converting body is being selected.

According to the present invention, the electric currents for operating the energy generating means can always be generated in the same direction when the energy generating means is operated. Therefore, each of the wiring electrodes except for the two terminal wiring electrodes of the energy generating means line can be supplied with the electric current flowing in opposite directions when the two energy generating means connected to the above-described wiring electrodes are operated.

Furthermore, since one energy generating means is selected at a time from each of a plurality of energy generating means groups, a plurality of energy generating means are operated simultaneously. As a result, recording can be performed at high speed. In this case, a problem may arise in that dot lines recorded on the recording medium are deflected due to the operating condition and the difference in the operating timing for each of the energy generating means lines. However, this can be prevented by diagonally forming the nozzle lines of the ink jet recording head at a predetermined angle.

Furthermore, the voltages of different levels which are applied to the two terminal wiring electrodes of the energy generating means to be operated are switched over between the wiring electrodes. Therefore, the direction in which electric currents flow in the wiring electrodes of the energy generating means and the direction in which electric currents flow in the wiring electrodes of the two terminal energy generating means can be switched over during the period in which the energy generating means are being operated.

Preferred embodiments of the present invention will now be described with reference to the drawings.

Figure 1:
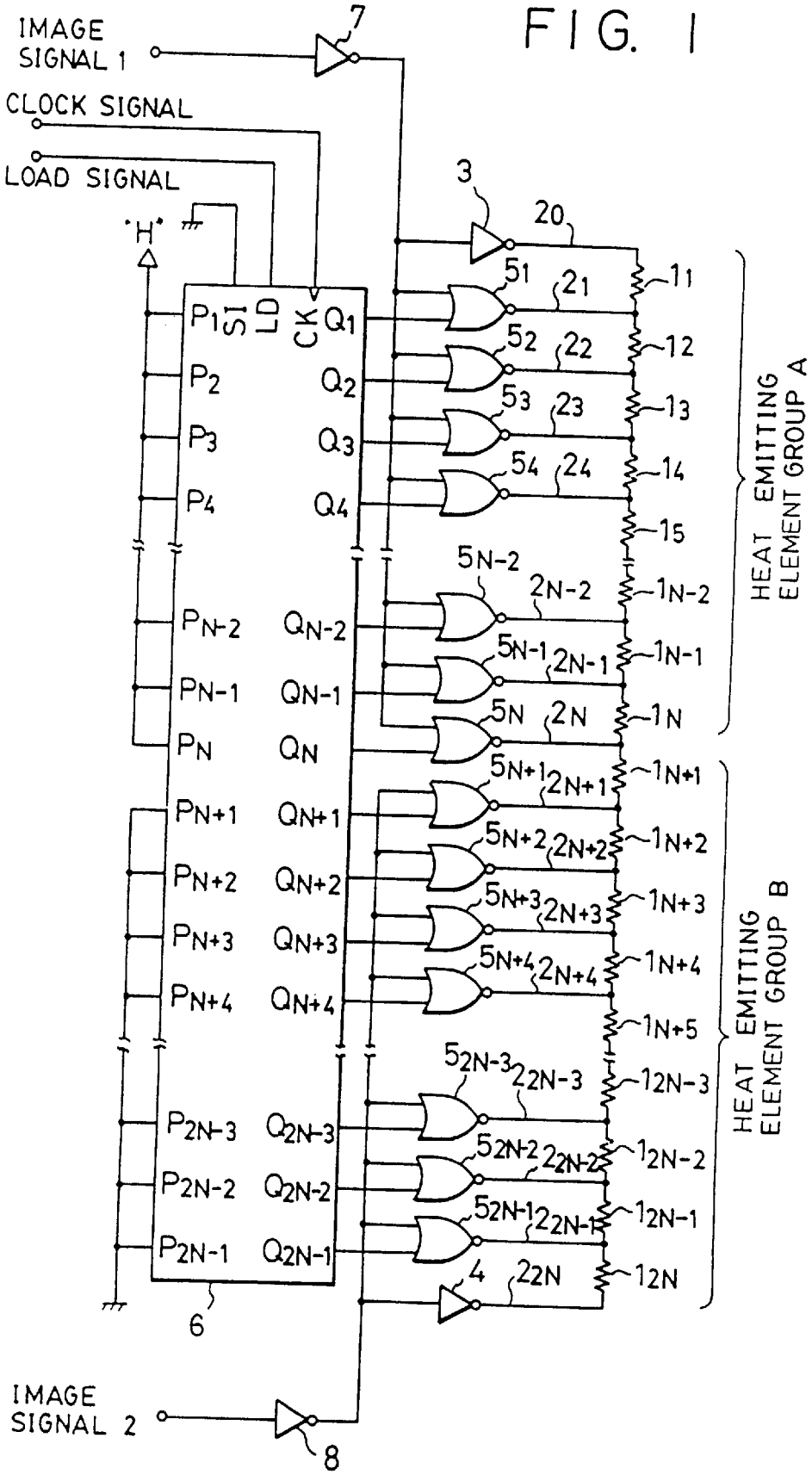
FIG. 1 is a circuit diagram for operating an ink jet recording head according to a first embodiment of the present invention.

FIG. 1 is a circuit diagram for discharging an ink jet recording head according to a first embodiment of the present invention.

The operating circuit according to this embodiment comprises inverter circuits 3, 4, 7 and 8, NOR circuits $\mathbf{5}_1, \ldots, \mathbf{5}_{2N-1}$ and a shift register 6. The operating circuit includes electrothermal conversion bodies (also called "heat emitting elements") $\mathbf{1}_1, \mathbf{1}_2, \ldots, \mathbf{1}_{2N-1}, \mathbf{1}_{2N}$ for supplying ink discharging energy to 2N nozzles provided for an ink jet recording head (omitted from illustration), the electrothermal conversion bodies $\mathbf{1}_1, \mathbf{1}_2, \ldots, \mathbf{1}_{2N-1}, \mathbf{1}_{2N}$ serving as energy generating means. The electrothermal conversion bodies $\mathbf{1}_1, \mathbf{1}_2, \ldots, \mathbf{1}_{2N-1}, \mathbf{1}_{2N}$ are divided into two groups composed of a heat emitting group A consisting of the heat emitting elements $\mathbf{1}_1, \mathbf{1}_2, \ldots, \mathbf{1}_{N-1}, \mathbf{1}_N$ and a heat emitting group B consisting of the heat emitting elements $\mathbf{1}_{N+1}, \mathbf{1}_{N+2}, \ldots, \mathbf{1}_{2N-1}, \mathbf{1}_{2N}$ so as to constitute the energy generating means line. The heat emitting elements of the heat emitting group A and those of the heat emitting group B are respectively successively operated starting from the heat emitting element $\mathbf{1}_1$ and the heat emitting element $\mathbf{1}_{N+1}$.

Two adjacent heat emitting elements of the above-described heat emitting elements $\mathbf{1}_1, \mathbf{1}_2, \ldots, \mathbf{1}_{2N-1}, \mathbf{1}_{2N}$ are successively connected in series so as to correspond to the nozzle. The end portions of the terminal heat emitting elements $\mathbf{1}_1$ and $\mathbf{1}_{2N}$ are respectively connected to the output terminals of inverter circuits 3 and 4 via lines $\mathbf{2}_0$ and $\mathbf{2}_{2N}$ which are wiring electrodes. The intersections of the heat emitting elements $\mathbf{1}_1, \mathbf{1}_2, \ldots, \mathbf{1}_{2N-1}, \mathbf{1}_{2N}$ are arranged in such a manner that, for example, the intersection of the heat emitting element 11 and the heat emitting element $\mathbf{1}_2$ is connected to the output terminal of the NOR circuit $\mathbf{5}_1$ via the wire $\mathbf{2}_1$ which is a wiring electrode. Similarly, the intersections are respectively connected to the dual input NOR circuits $\mathbf{5}_2, \ldots, \mathbf{5}_{2N-1}$ via lines $\mathbf{2}_2, \ldots, \mathbf{2}_{2N-1}, \mathbf{2}_{2N}$. Therefore, each of the heat emitting elements can be connected to the operating circuit by providing $2_{N+1}$ lines for 2N heat emitting elements so as to be successively operated.

Other input terminals of the above-described NOR circuits $\mathbf{5}_1, \mathbf{5}_2, \ldots, \mathbf{5}_{2N-1}$ are respectively connected to output terminals $Q_1, Q_2, \ldots, Q_{2N-1}$ of 2N−1 bit shift register 6. The shift register 6 is a serial input and parallel output shift register arranged in such a manner that it is brought to a low level (referred to as an "L level" hereinafter) when a serial data input terminal SI is connected (grounded). The shift register 6 shifts serial input data from the first bit toward the 2N−1 th bit in synchronization with the first transition of a clock signal of a predetermined period which is supplied to a clock input terminal CK. Furthermore, the shift register 6 has a load signal input terminal LD which receives a load signal at each N period of the clock. The load signal thus received enables parallel input data ($P_1, P_2, \ldots, P_N$: high level, referred to as an "H level" hereinafter) to be loaded. At this time, the outputs at each of the output terminals $Q_1, \ldots, Q_N$ are respectively H level, while those at the output terminals $Q_{N+1}, \ldots, Q_{2N-1}$ are L level.

The operating circuit according to this embodiment is arranged to be supplied with image signals 1 and 2 in synchronization with the clock signals supplied to the above-described shift register 6 in such a manner that the image signals 1 and 2 are supplied to correspond to the above-described energy generating means groups A and B serving as the energy generating means lines. The image signal 1 is supplied to the input terminal of the inverter circuit 3 and other input terminals of the NOR circuits $\mathbf{5}_1, \ldots, \mathbf{5}_N$ via the inverter circuit 7. The image signal 2 is supplied to the input terminal of the-inverter circuit 4 and other input terminals of the NOR circuits $\mathbf{5}_{N+1}, \ldots, \mathbf{52N-1}$ via the inverter circuit 2.

The operation according to this embodiment will now be described with reference to FIG. 2.

Figure 2:
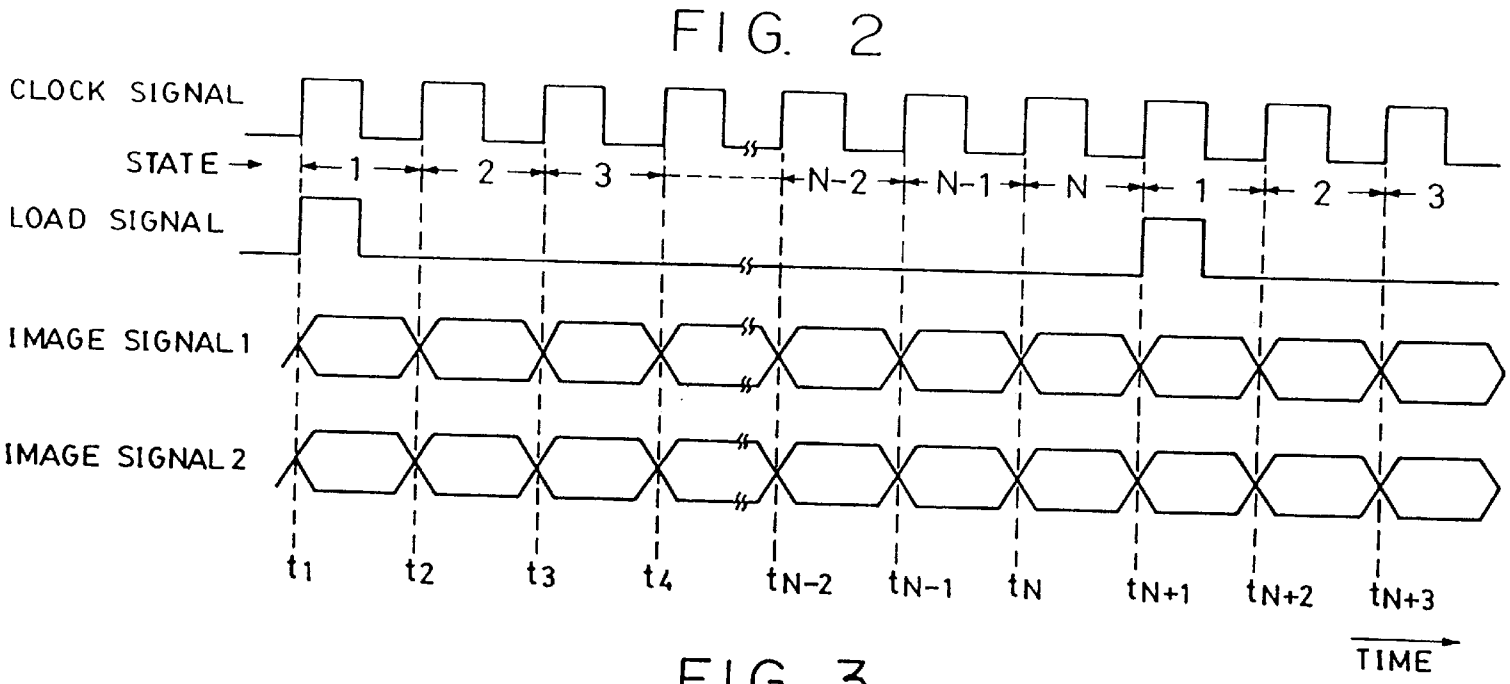
FIG. 2 is a timing chart which illustrates the operation of an operating circuit shown in FIG. 1.

FIG. 2 is a timing chart which illustrates the clock signal, the load signal and the image signals 1 and 2 to be supplied to the shift register 6.

The image signals 1 and 2 are H or L level signals which synchronize with the clock signals. When the image signals 1 and 2, representing an image to be produced, are H level, corresponding heat emitting elements are operated since two energy generating means lines are operated according to this embodiment.

If the load signal is supplied to the shift register 6 together with the clock signal at time $t_1$, the shift register, as described above, transmits H level outputs $Q_1, \ldots, Q_N$ and L level outputs $Q_{N+1}, \ldots Q_{2N-1}$ (status 1).

In this state, all of the NOR circuits $5_1, \ldots, 5_N$ transmit L level outputs of the same potential. Although the outputs from the inverter circuit 4 and the NOR circuits $5_{N+1}, \ldots, 5_{2N-1}$ are determined by the level of the image signal 2, the level of the potentials at their output terminals are the same. Therefore, when the image signal 1 is H level, only the output from the inverter circuit 3 is H level. Therefore, a difference in the potential is generated between the output terminal of the inverter circuit 3 and that of the NOR circuit $5_1$. As a result, an electric operating current flows from the inverter circuit 3 toward the NOR circuit $5_1$ through the heat emitting element $1_1$, causing the heat emitting element $1_1$ to be operated. As for the image signal 2, when the image signal is H level, the outputs from the inverter circuit 4 and the NOR circuits $5_{N+1}, \ldots, 5_{2N-1}$ are H level. Therefore, a difference in the potential is generated between the output terminal of the NOR circuit $5_{N+1}$ and the output terminal of the NOR circuit $5_N$ which has been brought to L level as described above. As a result, an electric current flows from the NOR circuit $5_{N+1}$ toward the NOR circuit $5_N$ through the heat emitting element $1_{N+1}$. Therefore, the heat emitting element $1_{N+1}$ is operated similarly to the heat emitting element $1_1$. If the image signal 1 is L level, the output from the inverter circuit 3 is L level which is the same level as that at the output terminal of the NOR circuit $5_1$. Therefore, no electric current flows, and the heat emitting device $1_1$ is not operated. If the image signal 2 is L level, all of the outputs from the NOR circuits $5_{N+1}, \ldots, 5_{2N-1}$ and the inverter circuit 4 are L level. Furthermore, since the output from the NOR circuit $5_N$ is L level as described above, the heat emitting element $1_{N+1}$ is not operated.

When a second clock signal is supplied to the shift register 6 at time $t_2$, the shift register 6 commences its shifting operation, causing the status of the outputs $Q_1, \ldots, Q_{2N-1}$ to be changed. In consequence, the outputs $Q_2, \ldots, Q_{N+1}$ become H level, while the other outputs $Q_1$ and $Q_{N+2}, \ldots, Q_{2N-1}$ become L level (status 2).

In this level, if the image signal 1 is H level, both the outputs from the inverter circuit 3 and that of the NOR circuit $5_1$ are H level, causing the outputs from the NOR circuits $5_2, \ldots, 5_N$ to be lowered to L level.

In this state, the electric current therefore flows from the NOR circuit $5_1$ toward the NOR circuit $5_2$ via the heat emitting element $1_2$. As a result, the heat emitting element $1_2$ is operated.

If the image signal 2 is H level, the outputs from the inverter circuit 4 and the NOR circuits $5_{N+2}, \ldots, 5_{2N-1}$ are H level. The output from the NOR circuit $5_{N+1}$ is lowered to L level since the output $Q_{N+1}$ from the shift register 6 has been raised to H level. Therefore, an electric current flows from the NOR circuit $5_{N+2}$ toward the NOR circuit $5_{N+1}$ via the heat emitting element $1_{N+2}$. As a result, the heat emitting element $1_{N+2}$ is operated.

As described above, the two heat emitting elements are simultaneously operated in each of status 1 and status 2. When status 1 is converted into status 2 in accordance with the shifting operation performed by the shift register 6, the heat emitting elements to be operated are successively shifted.

Table 1 shows the change in the outputs $Q_1, \ldots, Q_{2N-1}$ from the shift register 6 and the heat emitting elements to be operated in statuses (1 to N) which are changed with time as shown in FIG. 2.

TABLE 1

| Output from shift register 6 | $Q_1$ | $Q_2$ | $Q_3$ | | $Q_{N-2}$ | $Q_{N-1}$ | $Q_N$ | $Q_{N+1}$ | $Q_{N+2}$ | $Q_{N+3}$ | | $Q_{2N-2}$ | $Q_{2N-1}$ | $Q_{2N}$ | Heat Emitting Element to be Operated: Heat Emitting Group A | Heat Emitting Element to be Operated: Heat Emitting Group B |
|---|---|---|---|---|---|---|---|---|---|---|---|---|---|---|---|---|
| Status 1 | H | H | H | | H | H | H | L | L | L | | L | L | L | $1_1$ | $1_{N+1}$ |
| Status 2 | L | H | H | | H | H | H | H | L | L | | L | L | L | $1_2$ | $1_{N+2}$ |
| Status 3 | L | L | H | | H | H | H | H | H | L | | L | L | L | $1_3$ | $1_{N+3}$ |
| \| | \| | \| | \| | | \| | \| | \| | \| | \| | \| | | \| | \| | \| | \| | \| |
| Status N − 2 | L | L | L | | L | H | H | H | H | H | | H | L | L | $1_{N-2}$ | $1_{2N-2}$ |

TABLE 1-continued

| Output from shift register 6 | $Q_1$ | $Q_2$ | $Q_3$ | | $Q_{N-2}$ | $Q_{N-1}$ | $Q_N$ | $Q_{N+1}$ | $Q_{N+2}$ | $Q_{N+3}$ | | $Q_{2N-2}$ | $Q_{2N-1}$ | $Q_{2N}$ | Heat Emitting Element to be Operated: Heat Emitting Group A | Heat Emitting Element to be Operated: Heat Emitting Group B |
|---|---|---|---|---|---|---|---|---|---|---|---|---|---|---|---|---|
| Status N − 1 | L | L | L | | L | L | H | H | H | H | | H | H | L | $1_{N-1}$ | $1_{2N-1}$ |
| | | | | ≈ | | | | | | | ≈ | | | | | |
| Status N | L | L | L | | L | L | L | H | H | H | | H | H | H | $1_N$ | $1_{2N}$ |

As can be clearly seen from Table 1, the two heat emitting elements respectively selected from the two heat emitting groups A and B are simultaneously operated in each state. Furthermore, the heat emitting elements are successively operated in accordance with the status changed in accordance with the shifting operation performed by the shift register 6.

The period in which the heat emitting elements $1_1$, $1_2$, . . . , $1_{2N}$ emit heat is determined by the pulse width of the image signal 1 and the image signal 2. Therefore, by subjecting the image signal 1 and the image signal 2 to the pulse width modulation, the heating value of each of the heat emitting elements can be changed. Therefore, undesirable dispersion of the heat from the heat emitting devices can be effectively compensated. Furthermore, since the discharge of ink from the ink jet recording head can be changed in accordance with the heating value of the heat emitting element, the gradation of a color image or the like can be controlled.

Although the operation has been described in such a manner that the voltage levels of each of the input and output signals are arranged to be H level or L level for convenience, a voltage level of about +25 V must be applied to be capable of operating the heat emitting element. Therefore, in a case where ICs of the TTL level are used as the shift register 6 and the inverter circuits 7 and 8, the input terminal of each of the inverter circuits 3 and 4 and the NOR circuits $5_1$, . . . , $5_{2N-1}$ may comprise the TTL level IC. However, the output terminal to be directly connected to the heat emitting element must be arranged in such a manner that the above-described TTL level is converted into a voltage level which is capable of operating the heat emitting element. A positive or negative current is utilized, that is, an electric current that is transmitted from or supplied to the output terminal of each of the NOR circuits to be connected to the heat emitting elements. For example, as for the heat emitting element $1_1$ and the heat emitting element $1_2$, an electric current flows from the inverter circuit 3 to the NOR circuit $5_1$ when the heat emitting element $1_1$ is operated. Therefore, a negative current flows in the NOR circuit $5_1$. When the heat emitting element $1_2$ is operated, an electric current flows from the NOR circuit $5_1$ to the NOR circuit 52. Therefore, a positive current flows in the NOR circuit $5_1$. Therefore, the inverter circuits 3 and 4 and the NOR circuits $5_1$, . . . , $5_{2N-1}$ cannot comprise known open corrector type circuits for correcting the level. In consequence, any of other level converting circuits must be employed.

Figure 3:
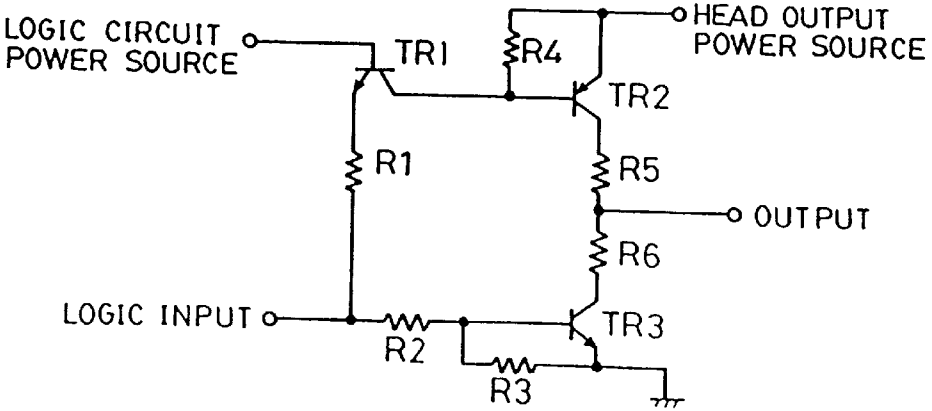
FIG. 3 is a circuit diagram which illustrates an example of a level converting circuit.

An example of the level converting circuit is shown in FIG. 3.

The level converting circuit comprise transistors TR1, TR2 and TR3 and resistors R1, R2, R3, R4, R5 and R6. When a predetermined voltage is applied to the logic circuit power source terminal of the level converting circuit and the head output power source terminal and a load resistance (omitted from illustration) is connected to the output terminal of the same, the transistors TR1 and TR2 are turned on if the logic input is L level. In consequence, the voltage of the head output power source appears at the output terminal. If the logic input is H level, only the transistor TR3 is turned on, causing the output terminal to be 0 V. Therefore, since the above-described level converting circuit acts as the inverter circuit, the TTL level inverter circuits 7 and 8 can be connected to the above-described inverter circuits 3 and 4 by arranging the structure in such a manner that the logic circuit power source is +5V and the head output power source is a voltage level (for example, +25 V) which is capable of operating the heat emitting elements., When each of the NOR circuit $5_1$, . . . , $5_{2N}$ is arranged in such a manner that a TTL level OR circuit is used in its front portion and the above-described level converting circuit is connected to its rear portion, the NOR circuits $5_1$, . . . , $5_{2N}$ are able to act as the NOR circuit. In consequence, the heat emitting elements can be operated.

The operation in a case where the operating circuit (see FIG. 1) includes that level converting circuit will be described with reference to the operation of the heat emitting element $1_2$ (which can be operated at +25 V) in the above-described status 2.

When the heat emitting element $1_2$ is operated, the output from the NOR circuit $5_1$ is +25 V (H level) and the output from the NOR circuit $5_2$ is 0 V (L level). Furthermore, the transistor TR2 is turned on in the NOR circuit $5_1$ as described above, and the transistor TR3 is turned on in the NOR circuit $5_2$. In consequence, an electric current flows from the NOR circuit $5_1$ to the NOR circuit $5_2$ via the heat emitting element $1_2$, causing the heat emitting element $1_2$ to be operated.

According to this embodiment, the nozzles formed in the ink jet recording head are successively operated. A problem arises, particularly in a case where the distance of movement of the recording head is too long with respect to the operation timing, that dot lines recorded on the recording medium are deflected. However, such deflection on the recording medium can be prevented by arranging the nozzle line of the ink jet recording head diagonally at a predetermined angle from the perpendicular direction.

According to this embodiment, two heat emitting elements are simultaneously operated. Therefore, an advantage can be obtained in that a power source of a large capacity need not be used. Furthermore, the number of the heat emitting elements to be operated may be arranged to be one, two or more.

Figure 4A:
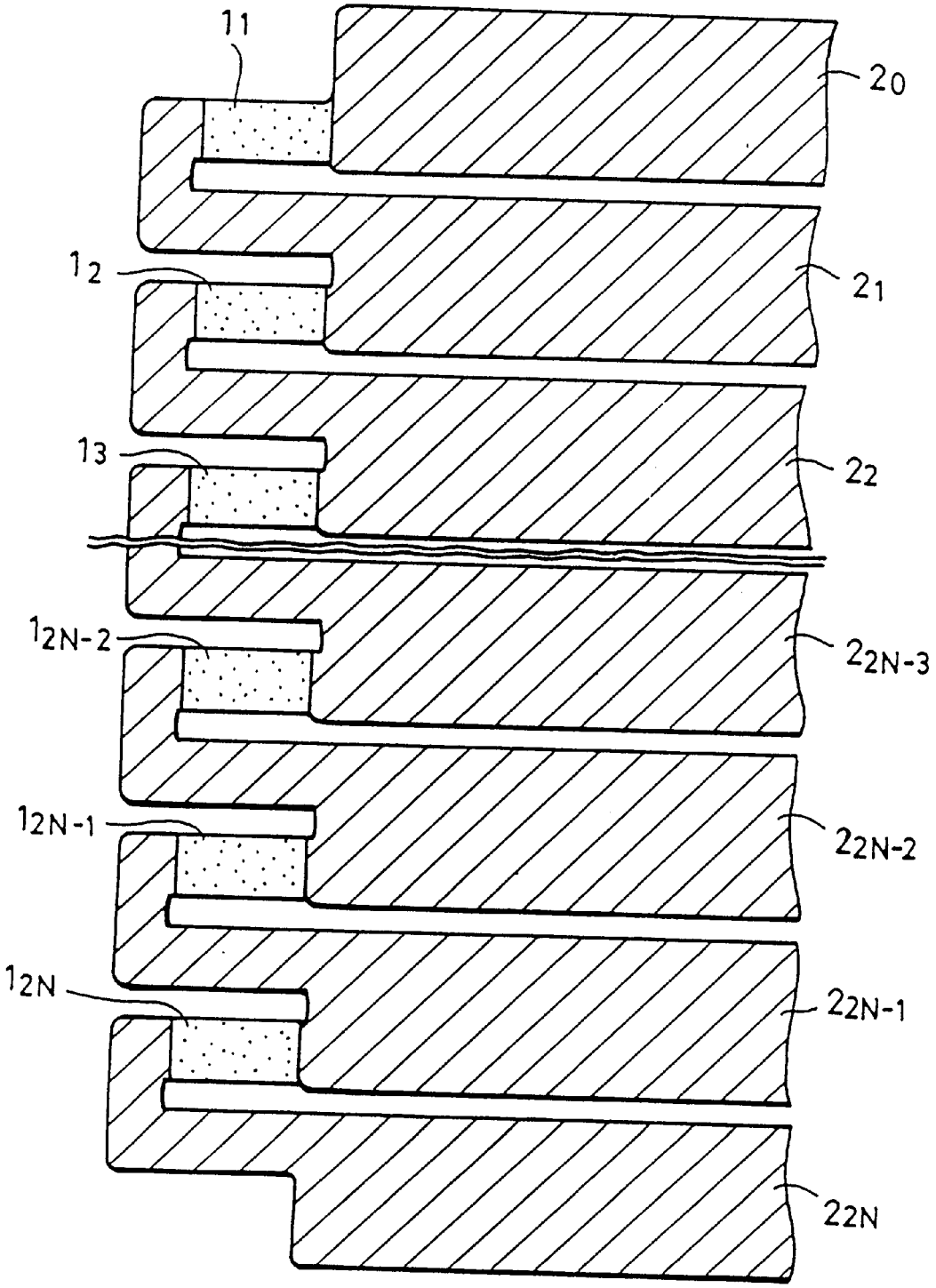
FIG. 4A is a plan view which illustrates a structure in which the direction of the heat emitting elements and that of the wiring pattern are in parallel to one another.
Figure 4B:
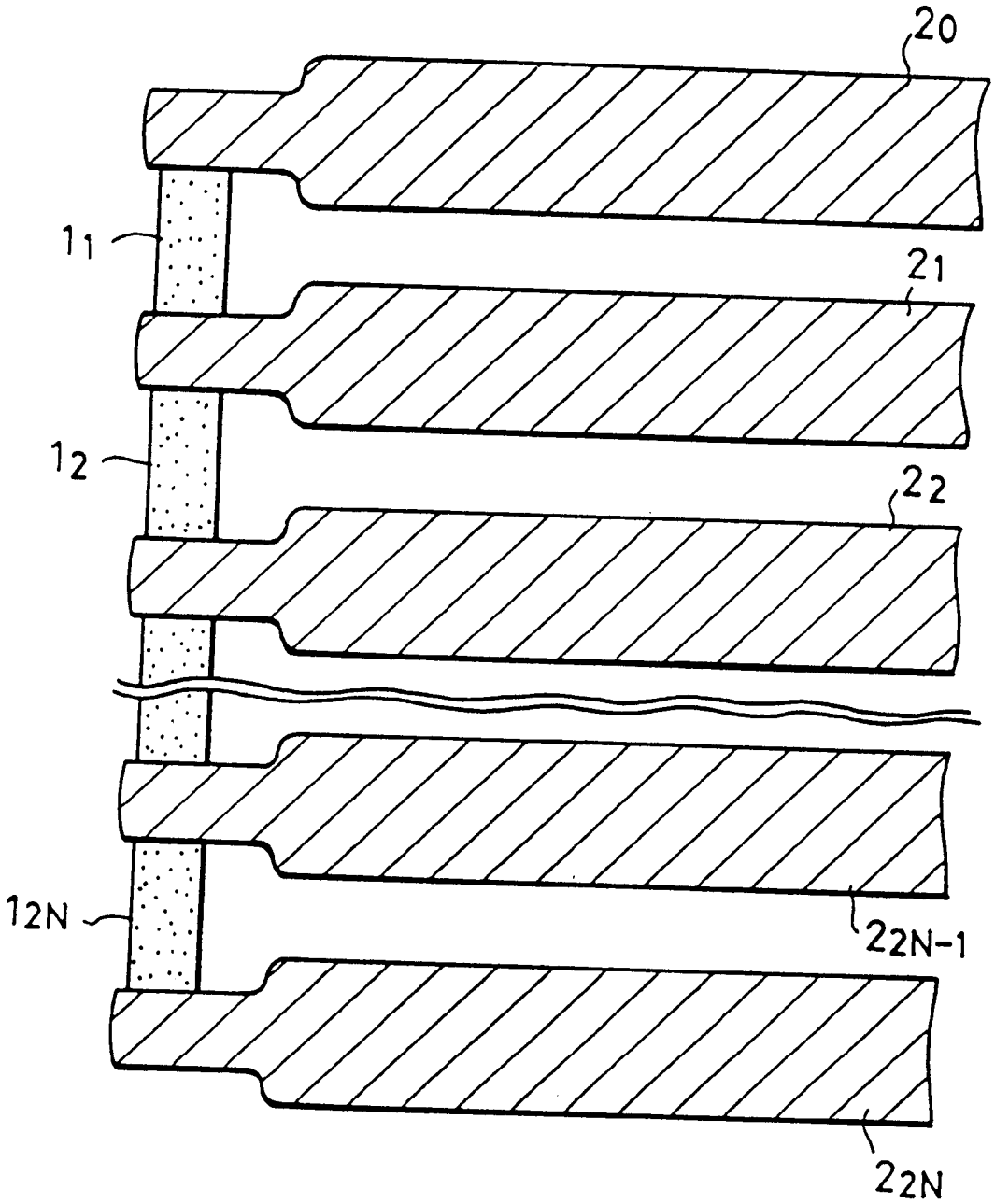
FIG. 4B is a plan view which illustrates a structure in which the direction of the heat emitting elements and that of the wiring pattern are perpendicular to one another.

FIGS. 4A and 4B illustrate structures in which a wiring pattern is formed in the ink jet recording head in such a manner that 2N heat emitting elements $\mathbf{1}_1, \ldots, \mathbf{1}_{2N}$ are connected to the operating circuit via 2N+1 lines $\mathbf{2}_0, \ldots, \mathbf{2}_{2N}$.

FIG. 4A illustrates a structure arranged in such a manner that the direction in which an electric current flows in the heat emitting elements $\mathbf{1}_1, \ldots, \mathbf{1}_{2N}$ is parallel to the direction in which the wiring pattern $\mathbf{2}_0, \ldots, \mathbf{2}_{2N}$ is formed. FIG. 4B illustrates a structure arranged in such a manner that the direction in which the electric current flows is perpendicular to the direction in which the wiring pattern is formed.

As can be clearly seen from FIGS. 4A and 4B, the width of each of the lines of the wiring pattern $\mathbf{2}_0, \ldots, \mathbf{2}_{2N}$ can significantly be enlarged. Therefore, the electrical resistance of the wiring can be reduced.

The heat emitting elements and the wiring pattern can be formed on an Si substrate by a thin film process. Furthermore, a protection layer made of $SiO_2$ or the like and an anti-cavitation layer made of Ta or the like are usually formed on the heat emitting elements and the wiring pattern so that the heat emitting elements and the wiring pattern are protected.

Since the direction in which the electric current flows in the wiring pattern of the above-described operating circuit changes, electrochemical reactions cannot easily take place. Therefore, the thickness of the above-described protection layer can be reduced in comparison to a conventional structure. Furthermore, if a material having satisfactory cavitation resistance such as a TaAl alloy is used to manufacture the heat emitting elements, the above-described protection layer and the anti-cavitation layer can be omitted from the structure. In consequence, the heat conduction between the heat emitting elements and ink is improved. Therefore, the ink can rapidly be heated, causing the ink, discharging force to be enlarged. Furthermore, the ink can be stably discharged, and reproduction of images can be improved.

Since the thickness of the wire of the wiring pattern can be enlarged, the wiring resistance can be reduced, as compared to conventional wiring patterns, when the heat emitting elements are mounted at high density. Furthermore, since the wiring pattern can be disposed in the direction of the heat emitting element line, the distance from the end portion of the substrate to the heat emitting element can be relatively shortened. As a result, a further improved ink jet recording head can be designed.

A second embodiment of the present invention will now be described.

Figure 5:
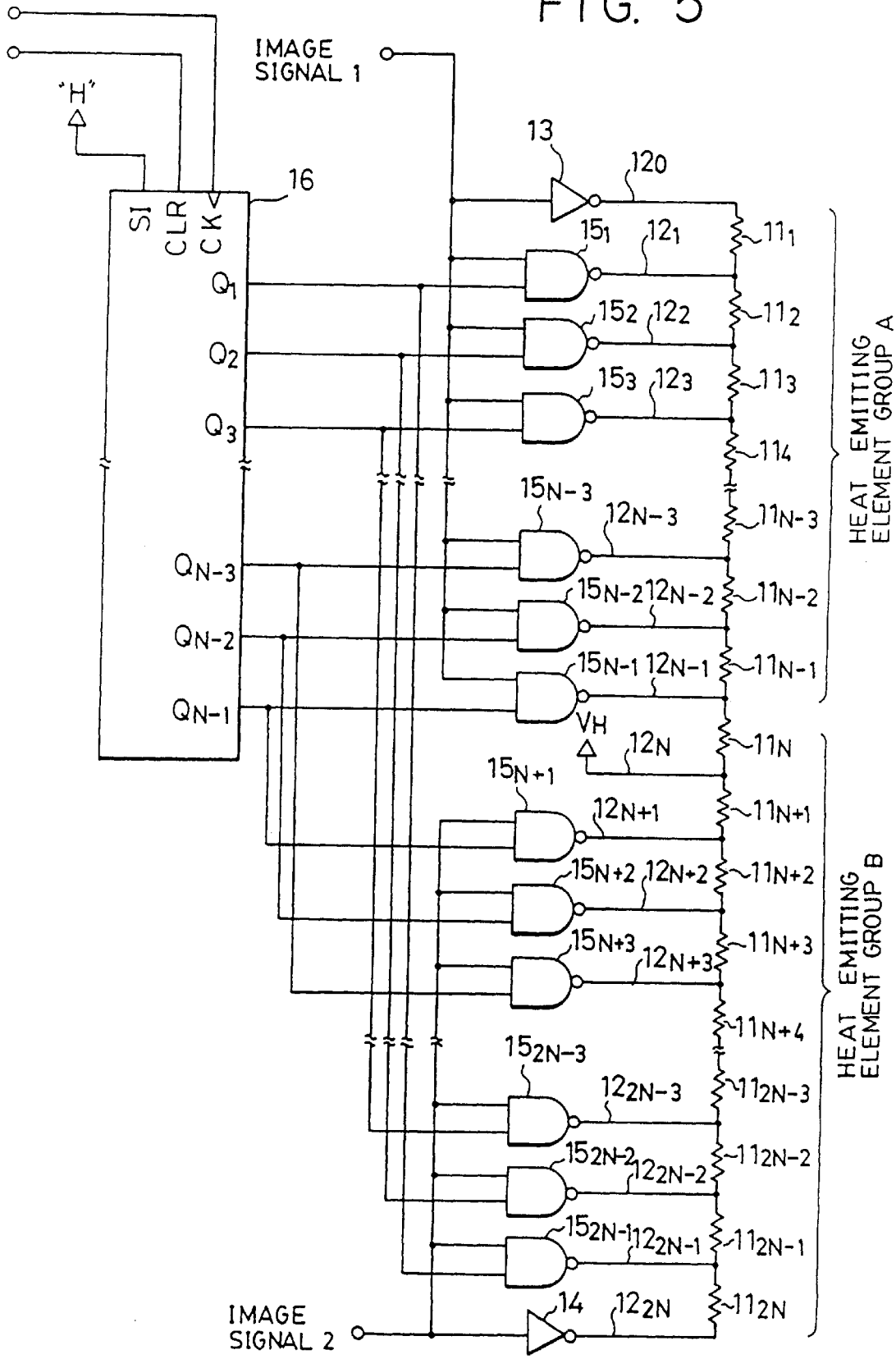
FIG. 5 is a circuit diagram which illustrates a second embodiment of the present invention.

FIG. 5 illustrates an operating circuit of the ink jet recording head according to this embodiment.

Similarly to the operating circuit according to the first embodiment, the operating circuit according to this embodiment is arranged in such a manner such that heat emitting elements $\mathbf{11}_1, \ldots, \mathbf{11}_{2N}$ provided to correspond to 2N nozzles formed in an ink jet recording head (omitted from illustration) are divided into a heat emitting group A composed of elements $\mathbf{11}_1, \ldots, \mathbf{11}_N$ and a heat emitting group B composed of elements $\mathbf{11}_{N+1}, \ldots, \mathbf{11}_{2N}$. The above-described heat emitting elements in the above-described two groups are successively operated.

According to this embodiment, the heat emitting elements $\mathbf{11}_1, \ldots, \mathbf{11}_{2N}$ are connected in series similarly to the first embodiment, and are connected to the operating circuit by 2N+1 wirings $\mathbf{12}_0, \ldots, \mathbf{12}_{2N}$. However, the wiring $\mathbf{12}_N$ connected to the junction between the heat emitting elements $\mathbf{11}_N$ and $\mathbf{11}_{N+1}$ is arranged to correspond to a voltage level (specified to be +25 V hereinafter) which is capable of operating the heat emitting elements $\mathbf{11}_N$ or $\mathbf{11}_{N+1}$. However, the present invention is not limited to the above-described voltage level of +25 V. It can, of course, be specified to any voltage level which is capable of operating the heat emitting elements. Therefore, according to this embodiment, 2N heat emitting elements are connected to the operating circuit by 2N+1 wirings.

The operating circuit according to this embodiment comprises an N−1 bit shift register 16, inverter circuits 13 and 14 and dual input NAND circuits $\mathbf{15}_1, \ldots, \mathbf{15}_{N-1}, \mathbf{15}_{N+1}, \ldots, \mathbf{15}_{2N}$. As for the image signals, the image signal 1 which corresponds to the above-described heat emitting group A and the image signal 2 which corresponds to the above-described heat emitting group B are supplied in synchronization with the clock signals supplied to the shift register 16.

The shift register 16 is a serial input and parallel output type register which sequentially shifts serial input data in response to the clock signals. According to this embodiment, since the serial input terminal is always H level, data items of H level are sequentially shifted.

Furthermore, the output terminals of the inverter circuits 13 and 14 and the NAND circuit $\mathbf{15}_1, \ldots, \mathbf{15}_{N-1}, \mathbf{15}_{N+1}, \ldots, \mathbf{15}_{2N}$ respectively include the level converting circuit shown in FIG. 3 similar to the structure according to the first embodiment.

The NAND circuits $\mathbf{15}_1, \ldots, \mathbf{15}_{N-1}$ are arranged in such a manner that one of the input terminals of each of the NAND circuits is connected to any of the corresponding outputs $Q_1, \ldots, Q_{N-1}$ of the shift register 16. The NAND circuits $\mathbf{15}_{N+1}, \ldots, \mathbf{15}_{2N}$ are arranged in such a manner that one of the input terminals of each of the NAND circuits is connected to the output terminal of the shift register 16 in a sequential order $Q_{N-1}, \ldots, Q_1$. Furthermore, the other input terminals of the NAND circuits $\mathbf{15}_1, \mathbf{15}_{N-1}$ are connected to the image signal 1 together with the input terminal of the above-described inverter circuit 13. The other input terminals of the NAND circuits $\mathbf{15}_{N+1}, \ldots, \mathbf{15}_{2N}$ are connected to the image signal 2 together with the input terminal of the above-described inverter circuit 14.

Figure 6:
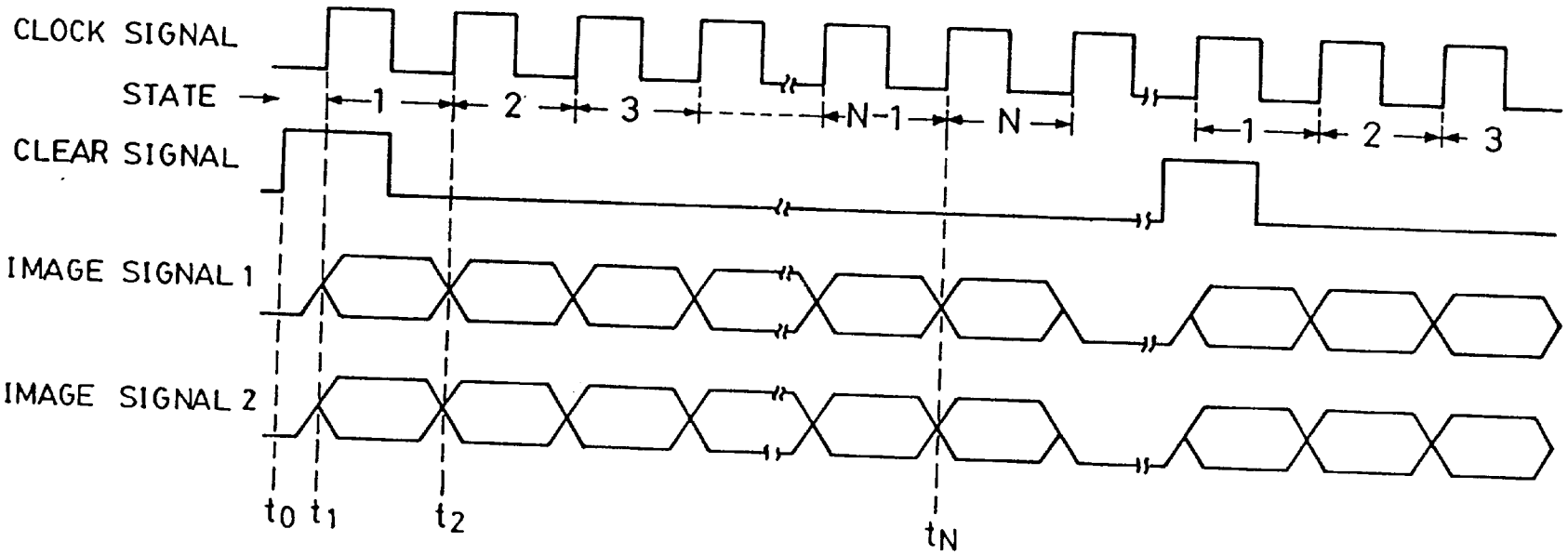
FIG. 6 is a timing chart which illustrates the operation of the operating circuit shown in FIG. 5.

The operation according to this embodiment will now be described with reference to a timing chart shown in FIG. 6.

When a clear signal is supplied to the shift register 16 at time $t_0$, the shift register 16 is cleared at the first transition timing of the clock signal at time $t_1$. In consequence, all of outputs $Q_1, Q_{N-1}$ are lowered to the L level (Status 1).

In Status 1, all of the outputs from NAND circuits $\mathbf{15}_1, \ldots, \mathbf{15}_{N-1}, \mathbf{15}_{N+1}, \ldots, \mathbf{15}_{2N}$ are +25 V.

At this time, the output from the inverter circuit 13 is 0 V when the image signal 1 is on H level, causing the heat emitting element $\mathbf{11}_1$ to be operated. When the image signal 2 is H level, the output from the inverter circuit 14 is 0 V, causing the heat emitting element $\mathbf{11}_{2N}$ to be operated. When both the image signals 1 and 2 are L level, the outputs from the inverter circuits 13 and 14 are +25V which is the same potential as that of the outputs from the NAND circuits $\mathbf{15}_1, \ldots, \mathbf{15}_{2N}$. In consequence, no electric current flows to the heat emitting elements $\mathbf{11}_1, \ldots, \mathbf{11}_{2N}$.

The first transition of the clock signal at time $t_2$ causes the output $Q_1$ from the shift register 16 to be raised to H level (Status 2). In Status 2, the output from each of the inverter circuits 13 and 14 and the NAND circuits $\mathbf{15}_1, \ldots, \mathbf{15}_{2N}$ are determined in accordance with the image signal 1 or 2. The output from the other NAND circuits $\mathbf{15}_2, \ldots, \mathbf{15}_{N-1}, \mathbf{15}_{N+1},$ $15_{2N-1}$ are +25 V. When the image signal 1 is H level at this time, the outputs from the inverter circuit 13 and the NAND circuit $15_1$ are respectively 0 V. An electric current flows from the NAND circuit $15_2$ to the NAND circuit $15_1$ via the heat emitting element $11_2$. In sequence, the heat emitting element $11_2$ is operated. When the image signal 2 is H level, the outputs from the inverter circuit 14 and the NAND circuit $15_{2N}$ are respectively 0 V. In consequence, an electric current flows from the NAND circuit $15_{2N-1}$ to the NAND circuit $15_{2N}$ via the heat emitting element $11_{2N-1}$, causing the heat emitting element $11_{2N-1}$ to be operated.

Thus, the heat emitting elements in the heat emitting group A are successively operated starting from the heat emitting element $11_1$ when the shift register 16 performs the shifting operation. Similarly, the heat emitting elements in the heat emitting group B are successively operated starting from the heat emitting element $11_{2N}$ when the shift register 16 performs the shifting operation.

As for time $t_N$ at which the clock signal enters the N th period, the outputs $Q_1, \ldots, Q_{N-1}$ from all of the shift registers are H level (Status N).

In this status, the output from each of the inverter circuits 13 and 14 and the NAND circuits $15_1, \ldots,$ $15_{N-1}, 15_{N+1}, \ldots, 15_{2N}$ are determined in accordance with the image signal or the image signal 2. When the image signal 1 is H level at this time, the output from each of the inverter circuit 13 and the NAND circuits $15_1, \ldots, 15_{N-1}$ is 0 V. However, an electric current flows to the NAND circuit $15_{N-1}$ via the heat emitting element 11N since the potential between the heat emitting elements $11_N$ and $11_{N+1}$ has been raised to +25 V. In consequence, the heat emitting element $11_N$ is operated. When the image signal 2 is H level, the output from each of the inverter circuit 14 and the NAND circuits $15_{N+1}, \ldots, 15_{2N}$ is 0 V. In consequence, an electric current flows to the NAND circuit $15_{N+1}$ via the heat emitting element $11_{N+1}$. Therefore, the heat emitting element $11_{N+1}$ is operated similarly to the heat emitting element $11_N$.

When the above-described status N has been ended, all of the heat emitting elements in the heat emitting groups A and B have been operated. Therefore, when the clear signal is again supplied to the shift register 16, the above-described operation is repeated from the first Status 1.

Since the shift register 16 is N−1 bit according to this embodiment, the circuit size can be reduced in comparison to the structure according to the first embodiment in which the 2N−1 bit shift register is used. As a result, the size of the recording apparatus can be reduced.

According to this embodiment, the nozzles are successively operated starting from the nozzles at the two ends so that ink is discharged. Therefore, there is a risk that deflection takes place in a recorded image when information is recorded on a recording medium due to the time difference of the operations of the nozzle while relatively moving the ink jet recording head with respect to the recording medium. The deflection of the type described above will take place in such a manner that the dot line recorded on the recording medium is in the form of a sideways U-shape. However, the deflection is not noticeable since the adjacent dots are not positioned a great distance away from each other. The deflection of the dot line can be prevented by shortening the time which is necessary to operate each of the heat emitting elements. The time which is necessary to operate all of the heat emitting elements is thereby considerably shortened in comparison to the repetition interval of the operations of the heat emitting elements.

A third embodiment of the present invention will now be described with reference to FIG. 7.

Figure 7:
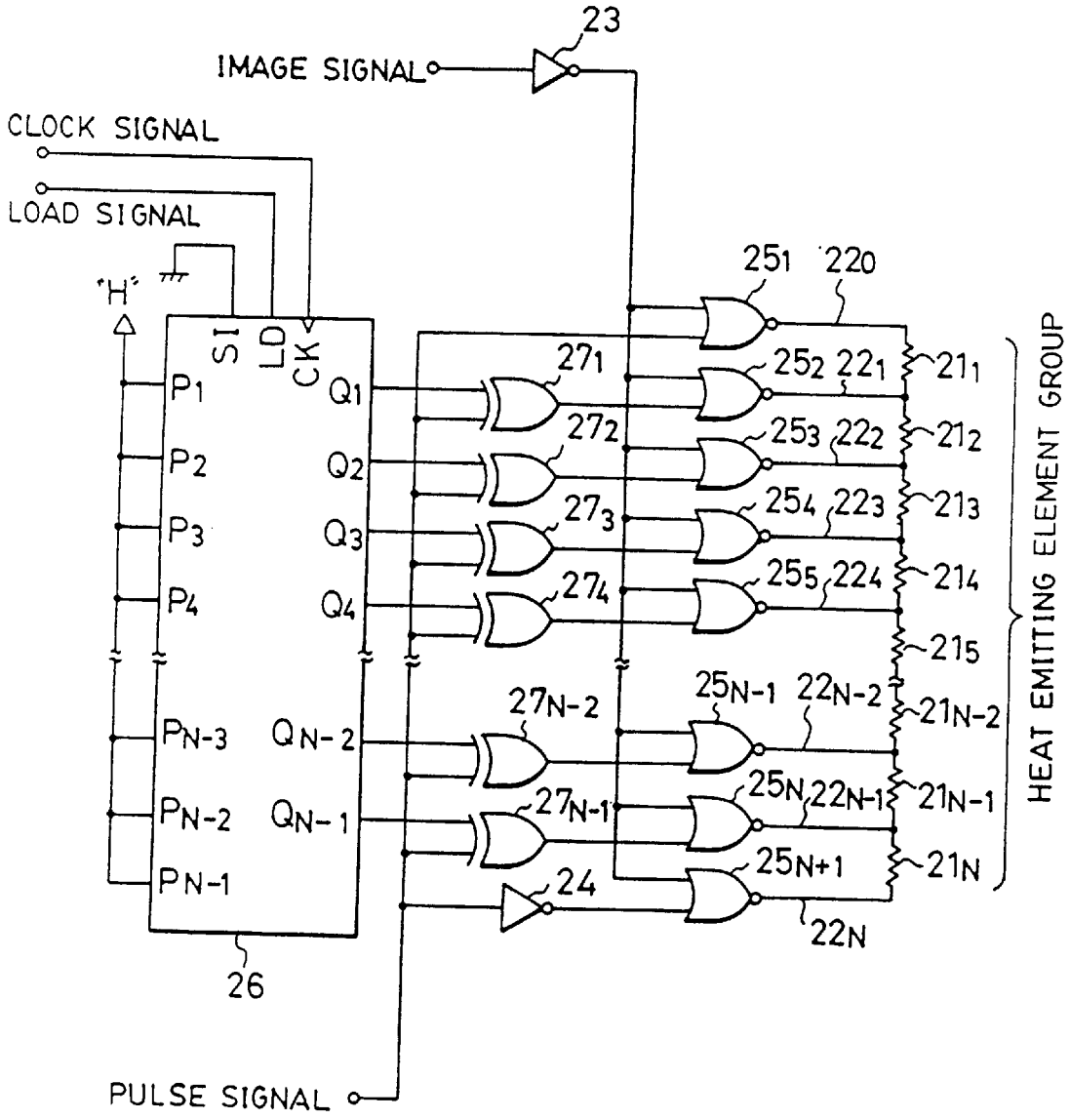
FIG. 7 is a circuit diagram which illustrates a third embodiment of the present invention.

FIG. 7 illustrates an operating circuit of the ink jet recording head according to the third embodiment of the present invention.

The operating circuit according to this embodiment is arranged in such a manner such that heat emitting elements $21_1, \ldots, 21_N$, respectively provided for N nozzles of the ink jet recording head are operated in response to the image signal. The operating circuit comprises inverter circuits 23 and 24, dual input NOR circuits $25_1, \ldots, 25_{N+1}$, an N−1 bit shift register 26 and dual input excessive OR circuits (referred to as an "EX-OR" circuits hereinafter) $27_1, \ldots, 27_{N-1}$.

The N heat emitting elements $21_1, \ldots, 21_N$ are connected to one another in series similarly to the above-described embodiments. One end portion of each of the terminal heat emitting elements $21_1$ and $21_N$ is connected to the output terminal of the NOR circuits $25_1$ and $25_{N+1}$ of the operating circuit via wirings $22_0$ and $22_N$. The adjacent end portions of the heat emitting elements $21_1, \ldots, 21_N$ are connected to the output terminal of the NOR circuits $25_2, \ldots, 25_N$ of the operating circuit in such a manner that, for example, the junction between the heat emitting elements $21_1$ and $21_2$ is connected to the same via a wiring $22_1$. Similarly, the adjacent end portions of the above-described heat emitting elements $21_2, \ldots, 21_N$ are connected to the output terminals of the NOR circuits $25_3, \ldots, 25_N$ via wirings $22_2, \ldots, 22_{N-1}$.

Also according to this embodiment, since N+1 wirings are provided for N heat emitting elements $21_1, \ldots, 21_N$, the heat emitting elements are connected to the operating circuit so as to be successively operated.

The NOR circuits $25_1, \ldots, 25_{N+1}$, similarly to the NOR circuit used in the structure according to the first embodiment, include the level converting circuit shown in FIG. 3. Input terminals of the NOR circuits $25_1, \ldots, 25_{N+1}$ are connected to the output terminal of the inverter circuit 23. The other input terminal of the NOR circuit $25_1$ is arranged to receive a high frequency pulse signal to be described later. Similarly, the other input terminal of the NOR circuit $25_{N+1}$ is arranged to receive a high frequency pulse signal. Furthermore, the other input terminals of the NOR circuits $25_2, \ldots, 25_N$ are connected to the output terminals of the corresponding EX-OR circuits $27_1, \ldots, 27_{N-1}$. One of the input terminals of the EX-OR circuits $27_1, \ldots, 27_{N-1}$ are sequentially connected to the outputs $Q_1, \ldots, Q_{N-1}$ of the shift register 26. The other input terminals of the EX-OR circuits are respectively arranged to receive high frequency pulse signals.

Each of the above-described high frequency pulse signals is a short period pulse signal which is shorter than the time in which each of the heat emitting elements is operated. When the level of the high frequency pulse signal is changed, the direction in which the operating current flows in the heat emitting element is changed.

The operation of this embodiment will now be described.

When a load signal is supplied to the shift register 26, H-level input data, which has previously been set to parallel input terminals $P_1, \ldots, P_{N-1}$, is loaded. In consequence, the outputs $Q_1, \ldots, Q_{N-1}$ of the shift register 26 are raised to H level. When the image signal is H level at this time, the heat emitting element $21_1$ is operated. When the level of the high frequency pulse signal is changed from L level to H level, the direction in which the electric current flows in the heat emitting element $21_1$ is changed between the NOR circuits $25_1$ and $25_2$ during the above-described operation. When the high frequency pulse signal is H level, the output from the NOR circuit $25_1$ is 0 V. Furthermore, the output from the EX-OR circuit $27_1$ is lowered to L level and the output from the NOR circuit $25_2$ is thereby made to be +25 V. In consequence, an electric current flows from the NOR circuit $25_2$ to the NOR circuit $25_1$ via the heat emitting element $21_1$. When the high frequency pulse signal is L level, the output from the NOR circuit $25_1$ is +25 V. Furthermore, the output from the NOR circuit $25_2$ is 0V, causing an electric current to flow from the NOR circuit $25_1$ to the NOR circuit $25_2$ via the heat emitting element $21_1$.

As described above, this embodiment is arranged in such a manner that the operating voltage determined in accordance with the image signal is switched over at the two terminal ends of the heat emitting elements in accordance with the level change of the high frequency pulse signal. Thus, the direction in which the electric current flows in the wirings connected to the two ends of the heat emitting elements is changed.

The other heat emitting elements $21_2$, . . . , $21_N$ are successively operated when the shift register 26 performs the shifting operation. Furthermore, the direction in which the electric current flows in the heat emitting element is changed during the above-described operation of the shifting operation in accordance with the level change of the high frequency pulse signal.

The ink jet recording heads for discharging ink by heating the ink usually use heat emitting elements and wiring material which does not suffer from corrosion due to the electrochemical reactions. However, the employed materials cannot maintain satisfactory resistance against the electrochemical reactions after they have been heated due to the heat emission of the heat emitting elements. Accordingly, the present invention is arranged in such a manner that the direction in which the electric current flows in the heat emitting element during the operation of the heat emitting element is changed. In consequence, the corroding electrochemical reactions can be prevented, causing the durability of the ink jet recording head to be improved significantly.

The timing of the above-described high frequency pulse signal must not be synchronized with the timing at which the heat emitting element is operated. However, the frequency must be higher than the clock signal to be supplied to the shift register 26 to obtain the desired effect. Since the potentials at the two terminals of the heat emitting elements are changed at such high speed as described above, the potentials are switched in a shorter time than the time which takes for the ions to be diffused by the electrochemical reactions. Therefore, the problems that arise due to the electrochemical reactions can be effectively extremely prevented. Furthermore, generation of bubbles due to electrolysis of the ink can be prevented as well as the corrosion of the wiring pattern and the like.

A fourth embodiment of the present invention will now be described with reference to FIG. 8.

Figure 8:
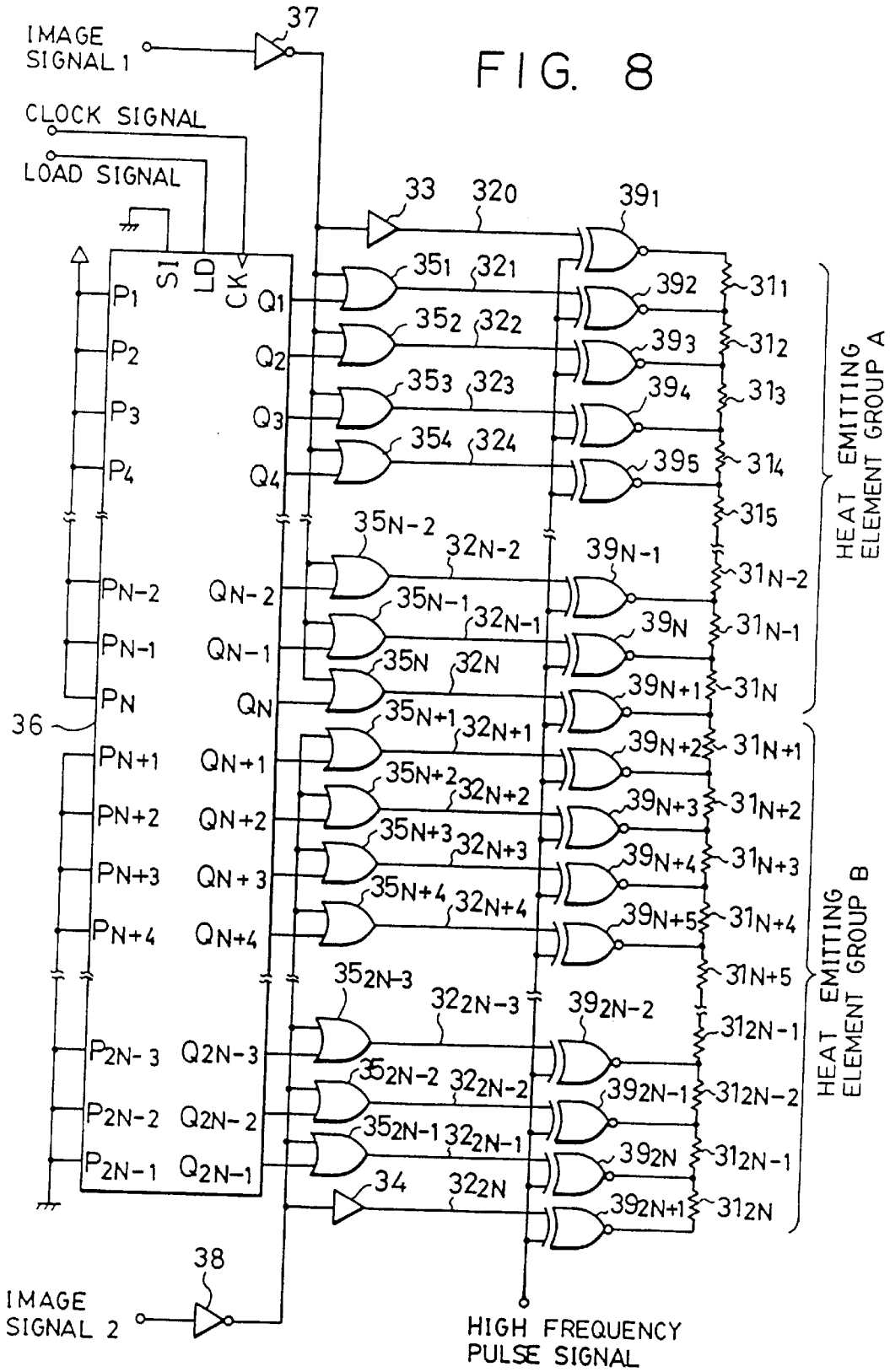
FIG. 8 is a circuit diagram which illustrates a fourth embodiment of the present invention.

FIG. 8 illustrates an operating circuit of the ink jet recording head according to this embodiment.

The operating circuit according to this embodiment is arranged in such a manner that the inverter circuits 3 and 4 of the operating circuit shown in FIG. 1 are replaced by TTL level buffer circuits 33 and 34. Furthermore, the NOR circuits $5_1$, . . . , $52_{N-1}$ are replaced by TTL level dual input OR circuits $35_1$, . . . , $35_{2N-1}$. In addition, exclusive NOR circuits (referred to as "EX-NOR circuits" hereinafter) $39_1$, . . . , $38_{2N+1}$ are positioned in wirings $32_0$, . . . , $32_{2N}$ disposed between the heat emitting elements $31_1$, . . . , $31_{2N}$ and the OR circuits $35_1$, . . . , $35_{2N-1}$ and the buffer circuits 33 and 34. The heat emitting elements $31_1$, . . . , $31_{2N}$ are divided into two heat emitting groups A and B and connected to one another in series similarly to that shown in FIG. 1.

The operating circuit according to this embodiment is arranged-in such a manner that the output terminals of the EX-NOR circuits $39_1$, . . . , $39_{2N+1}$ are respectively connected to the two terminals of the heat emitting elements $31_1$, . . . , $31_{2N}$. An input terminal of each of the EX-NOR circuits $39_1$, . . . , $39_{2N+1}$ is arranged to receive the high frequency pulse signal similarly to the third embodiment. The other input terminals of the EX-NOR circuits are connected to the output terminals of the buffer circuits 33 and 34 and the OR circuits $35_1$, . . . , $35_{2N-1}$. Therefore, the operating circuit according to this embodiment is connected to the 2N heat emitting elements by 2N+1 wirings.

Since the above-described EX-NOR circuits $39_1$, . . . , $39_{2N+1}$ are the elements through which the electric current for operating the heating elements $31_1$, . . . , $31_{2N}$ flows, they include the level converting circuit shown in FIG. 3.

Also according to this embodiment, the heat emitting elements in the heat emitting groups A and B are successively operated when the shift register 36 performs the shifting operation similarly to the first embodiment. Furthermore, the direction in which the electric current flows in each of the heat emitting elements is switched over during the period in which the heat emitting elements are operated similarly to the third embodiment, the above-described switching over taking place in accordance with the level change of the high frequency pulse signal.

For example, the heat emitting elements $31_1$ and $31_{N+1}$ are simultaneously operated in Status 1 shown in Table 1. The electric current flows in the heat emitting element $31_1$ in a direction from the EX-NOR circuit $39_2$ to the EX-NOR circuit $39_1$ when the high frequency pulse signal is H level since the output from the EX-NOR circuit $39_1$ is 0 V and the output from the EX-NOR circuit $39_2$ is +25 V. When the high frequency pulse signal is L level, the output from the EX-NOR circuit $39_1$ is +25 V, which is the H level operating voltage, and the output from the EX-NOR circuit $39_2$ is 0 V which is the L level operating voltage. In consequence, the electric current flows from the EX-NOR circuit $39_1$ to the EX-NOR circuit $39_2$.

As for the heat emitting element 31N+1, the direction in which the electric current flows is switched over between the EX-NOR circuits $39_N$ and $39_{N+1}$ in accordance with the level change of the high frequency pulse signal similarly to the above-described heat emitting element $31_1$.

According to this embodiment, since two heat emitting elements are simultaneously operated, data can be recorded at a relatively high speed in comparison to the third embodiment. Furthermore, the problems, which can arise in the wirings and the heat emitting elements due to the electrochemical reaction, can be prevented. If the second embodiment employs the structure in which the EX-NOR circuit is disposed similarly to this embodiment so as to be applied with the high frequency pulse signals, similar effects can be obtained.

When a plurality of the above-described operating circuits are provided for one ink jet recording head and the number of the energy generating means lines is increased in accordance with the number of the operating circuits provided, a multiplicity of heat emitting elements can simultaneously be operated. In consequence, data can be recorded at high speed. The ink jet recording head to be operated by the thus constituted operating circuit may be in the form arranged in such a manner that a plurality of nozzles are arranged in a straight line. However, the present invention is not limited to this. For example, in a case where the ink jet recording head, which discharges ink perpendicularly to the substrate on which the heat emitting elements are mounted, the nozzle can be relatively freely arranged. In this case, if the nozzles are arranged diagonally at a predetermined angle to compensate for the operating timing, an image-without deflection can be formed even if a plurality of heat emitting elements are simultaneously operated for each of a plurality heat emitting groups.

Furthermore, the present invention is not limited to an ink jet recording head in which each of the nozzles has a nozzle wall. For example, any nozzle may be employed if it can accurately eject ink to the desired target, for example, a structure having slit-like discharge ports which correspond to a plurality of desired of targets.

A typical recording apparatus which employs the present invention will now be described with reference to FIG. 9.

Figure 9:
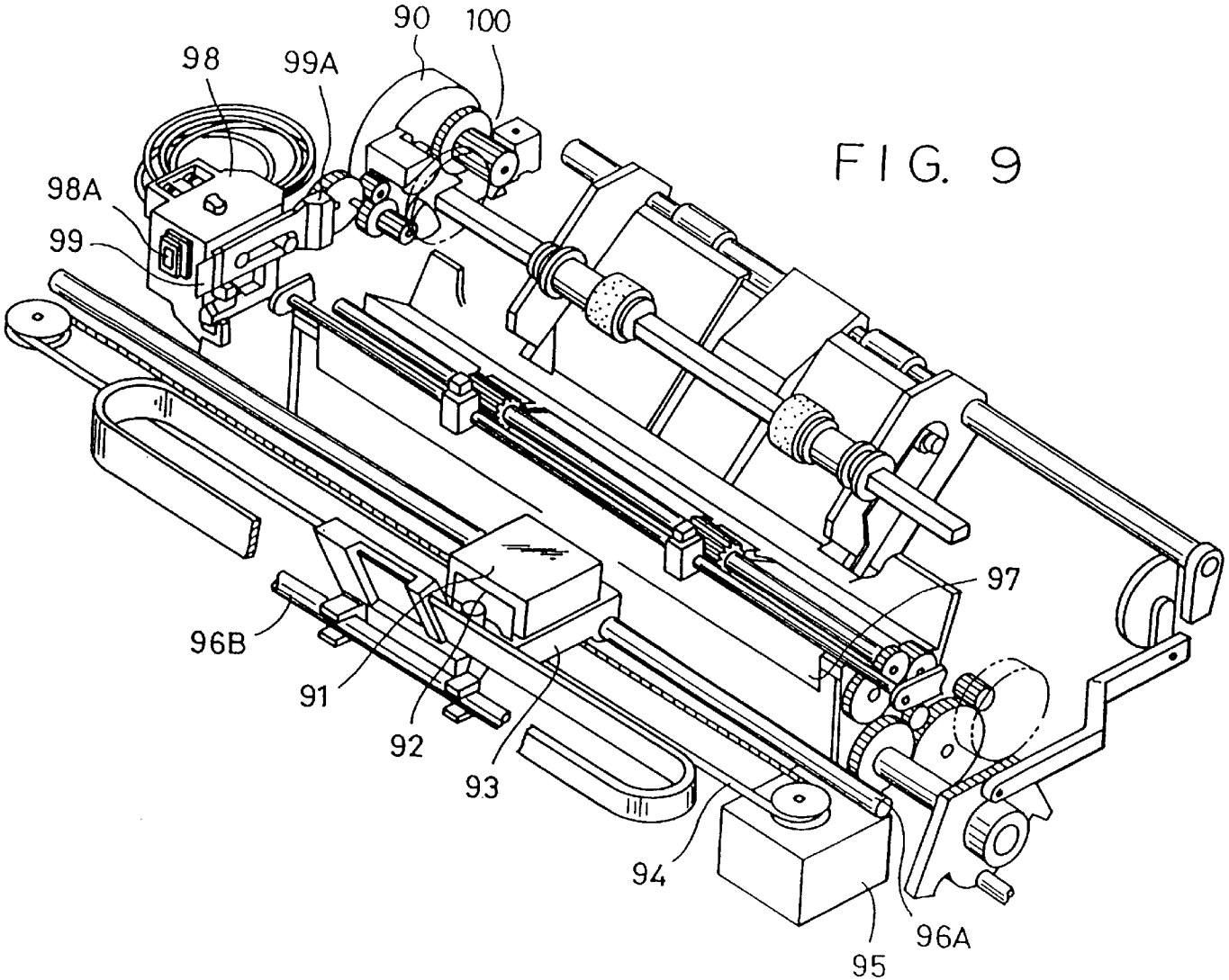
FIG. 9 is a perspective view which illustrates an example of a recording apparatus to which the present invention is applied.

FIG. 9 is a perspective view which illustrates an ink jet recording apparatus having the operating circuit arranged to act in accordance with-the discharge method for the ink jet recording head according to the present invention.

The ink jet recording apparatus has a carriage 93 for carrying an ink jet head cartridge 91 constituted by integrating an ink jet recording head 92 and an ink chamber (omitted from illustration). The carriage 93 is connected to a drive belt for transmitting the driving force of a drive motor 95. The carriage 93 contacts and is guided by two parallel guide shafts 96A and 96B. The ink jet recording head 92 reciprocates, due to the driving force transmitted from the drive motor 95, along recording paper serving as a recording medium. The recording paper is supplied from a medium feeding device (omitted from illustration) to a platen 97 disposed adjacent the discharging surface of the ink jet recording head 92. In consequence, data is recorded on the recording paper.

The ink jet recording head 92 has a nozzle group for discharging ink from the discharge surface which confronts the recording surface of the recording paper, the nozzle group discharging the ink by utilizing thermal energy. The ink is supplied from the ink chamber integrally formed in the ink jet head cartridge 91 to the ink jet recording head 92.

The ink jet recording apparatus has a head returning device 98 having a cap portion 98A which is operated so as to confront the discharge surface of the ink jet recording head 92 by a motor 90 via a transmission mechanism 100 at a position in a range outside the recording range of the ink jet recording head 92. The cap portion 98A of the head returning device 98 caps the discharging surface of the ink jet recording head 92.

The head returning device 98 absorbs the ink by a proper absorbing means or forcibly feeds the ink by a proper pressurizing means disposed in an ink supply passage connected to the ink jet recording head 92 when the cap portion 98 caps the discharge surface of the ink jet recording head 92 at the time of the head position returning operation. As a result, the head returning device 98 performs a discharge function-recovering operation in such a manner that undesirably viscous ink is forcibly discharged and thereby removed.

The head returning device 98 has a blade 99 on the side surface thereof, the blade 99 serving as a wiping member made of silicone rubber and being held by a blade holding member 99A in a cantilever manner. The blade 99 is, similarly to the head returning device 98, operated by the motor 90 and the transmitting mechanism 100. In consequence, the head returning device 98 is able to engage the discharge surface of the ink jet recording head 92. As a result, the blade 99 is allowed to project into the path which the ink jet recording head 92 is moved. In consequence, dew, wet portions and dust on the discharge surface of the ink jet recording head 92 can be wiped clean when the ink jet recording head 92 is moved.

The ink jet recording apparatus includes the operating circuit for controlling the discharging operation performed by the ink jet recording head 92 according to the above-described embodiments, the operating circuit being disposed in a print control block (omitted from illustration). The operating circuit controls the ink discharging operation. The ink jet recording apparatus thus constituted is able to maintain a satisfactory quality of recording for a significantly longer time in comparison to that realized by the conventional apparatus.

The present invention realizes a significant effect in a recording head or a recording apparatus which comprises a means (for example, an electrothermal converting body or a laser beam) for generating thermal energy to discharge ink, the recording head or the recording apparatus performing recording by causing the phase of the ink to be changed by utilizing the thus generated thermal energy.

It is preferable that a recording head or a recording apparatus be employed which is structured and arranged to act in accordance with those disclosed in, for example, U.S. Pat. Nos. 4,723,129 and 4,740,796. The above-described system can be applied to both a so-called on-demand type and a continuous type recording head. In a case of the on-demand type, at least one operating signal, which corresponds to information to be recorded and which causes a rapid temperature rise of recording liquid (ink) exceeding its nuclear boiling to take place, is supplied to an electrothermal converting body which is disposed to correspond to a sheet or a liquid passage in which the recording liquid (ink) is held. In consequence, thermal energy is generated in the electrothermal converting body, causing the film boiling to take place in the recording liquid at a position in the vicinity of the surface of the recording head on which heat is applied. As a result, bubbles are formed in the recording liquid corresponding to the operating signals. The enlargement and contraction of the thus generated bubble causes the recording liquid to be discharged through the discharge port. As a result, at least one droplet can be formed. If the operating signal is arranged as pulses, the bubble can be quickly and properly enlarged and contracted. Therefore, the recording liquid is discharged with significant reliability. It is preferable that an operating signals disclosed in U.S. Pat. Nos. 4,463,359 and 4,345,262 be employed as the above-described pulse operating signals. If conditions which relate to the rate of the temperature rise of the above-described heat-acting surface similar to those disclosed in U.S. Pat. No. 4,313,124 are achieved, further improved recording can be realized.

As the structure of the recording head, the scope of the present invention includes a structure arranged in such a manner that the heat acting portion is disposed in a bent portion of a liquid passage as disclosed in U.S. Pat. Nos. 4,558,333 and 4,459,600 as well as the above-disclosed structure arranged in such a manner that the discharge port, the liquid passage and the electrothermal converting body are combined (either in a straight liquid passage or a perpendicular liquid passage).

If a full line type recording head having a length which corresponds to the maximum width of the recording medium on which the recording apparatus is able to record data is desired, the above-disclosed structure can achieve the desired length by combining a plurality of recording heads or by forming a larger single structure. In any case, the present invention is able to realize a significant effect.

The present invention is effective when it is combined with an interchangeable chip type recording head detachably mounted on the body of the apparatus so as to be electrically connected to the apparatus body and supplied with ink from the apparatus body. In addition, the same can be applied to a structure in which a cartridge type recording head is used, the cartridge type recording head having an integral ink chamber.

It is preferable that the recording head returning means and an auxiliary means are included in the recording apparatus according to the present invention since the effect of the present invention can further be stabilized. Specifically, the recording stability can be improved by providing a recording head capping means, a cleaning means, a pressurizing or absorbing means, a preliminary heating means comprising the electrothermal converting body or another heating element, or a preliminary discharge mode.

The recording apparatus may have a recording mode in which only a single color image such as a black image is recorded. In addition, the recording heads may be integrally formed or a plurality of the recording heads may be combined. The present invention is effectively applied to an apparatus capable of recording an image formed by a plurality of different color components or a full color image realize by mixing color components.

As the recording apparatus having a recording mechanism which employs the liquid jet recording head according to the present invention, terminal equipment for outputting an image and acting as a component of information processing equipment, such as a computer, a copying machine comprising a reader or the like and a facsimile machine having data transmitting/receiving function, may be employed.

Figure 10:
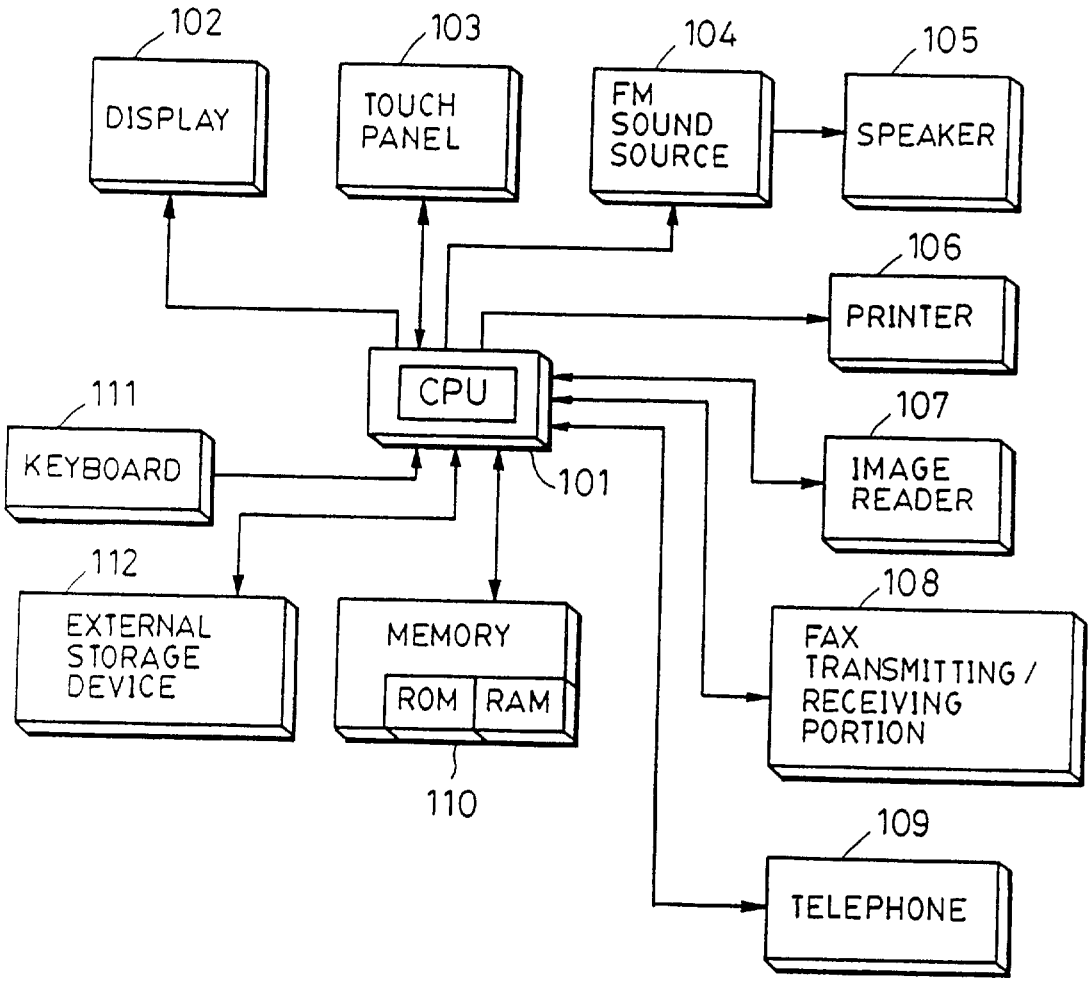
FIG. 10 is a block diagram which illustrates the schematic structure constituted by applying the recording apparatus according to the present invention to an information processing apparatus.

FIG. 10 is a block diagram which illustrates the schematic structure constituted by combining the recording apparatus according to the present invention and a word processor, a personal computer, a facsimile machine or an information processing apparatus having a function as a copying machine.

Referring to the drawing, reference numeral 101 represents a control portion for controlling the overall operation of the apparatus. The control portion 101 comprises a CPU such as a microprocessor and a variety of input/output (I/O) ports so as to transmit control signals and data signals to the corresponding elements and receive control signals and data signals from the corresponding elements. Reference numeral 102 represents a display portion on which various menus, document information and image data read by an image reader 107 are displayed. Reference numeral 103 represents a transparent pressure sensitive touch panel formed on the display portion 102 with which items and coordinates are input on the display portion 102 by depressing the surface thereof by a finger or the like.

Reference numeral 104 represents an FM (Frequency Modulation) sound source portion for storing music information processed by a music editor or the like in a memory portion 110 and an external memory device 112 as digital data so as to perform the FM modulation of the stored digital data read from the memory or the like. An electric signal generated in the FM sound source portion 104 is converted into audible sound. A printer portion 106 is an element serving as an output terminal of a word processor, a personal computer, a facsimile to which the recording device according to the present invention is applied.

Reference numeral 107 represents an image reader portion for photoelectrically reading original document data so as to input it, the image reader portion being disposed in a passage through which the original document is passed. In consequence, a facsimile document, a copied document and the like are read by the image reader portion 107. Reference numeral 108 represents a facsimile (FAX) transmitting/receiving portion for receiving a sent facsimile signal and decoding it, the facsimile transmitting portion 108 having an interface function with an external portion. Reference numeral 109 represents a telephone portion having a variety of telephone functions such as ordinary and message memorable telephone functions.

Reference numeral 110 represents a memory portion comprising a ROM for storing a system program, a manager program, the other application program, character fonts and dictionaries. The memory portion 110 further stores an application program loaded from an external storage portion 112 and document information. The memory portion 110 further comprises a video RAM.

Reference numeral 111 represents a keyboard portion with which document information and a variety of commands are input.

Reference numeral 112 represents the external storage portion arranged to operate on a floppy disk or a hard disk as a storage medium, the external storage portion 112 storing document information, music or voice information and a user's application program.

Figure 11:
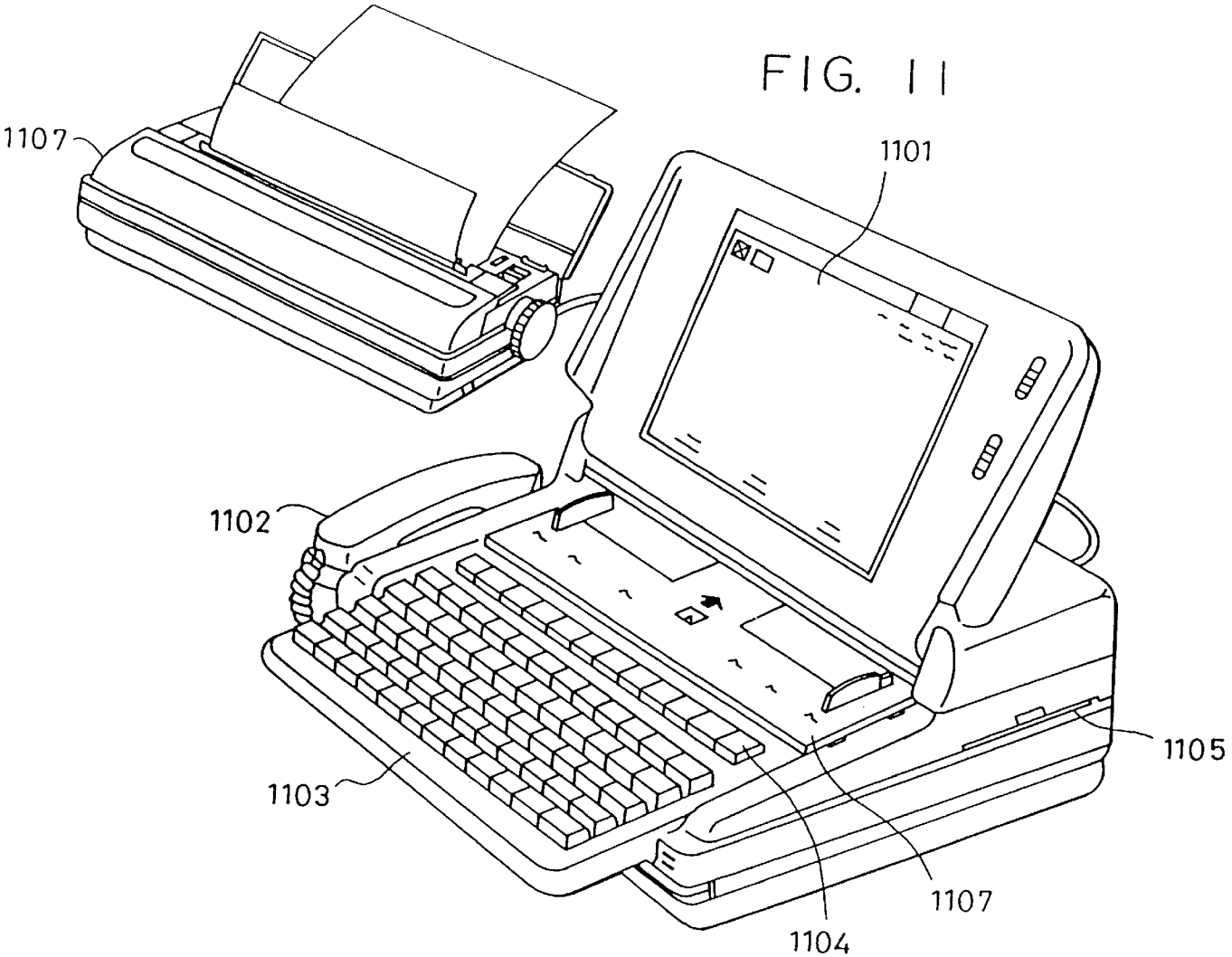
FIG. 11 is a schematic view which illustrates an example of the information processing apparatus shown in FIG. 10.

FIG. 11 is a schematic view of the information processing apparatus shown in FIG. 10.

Referring to FIG. 11, reference numeral 1101 represents a flat panel display which uses liquid crystal, the flat panel display 1101 displaying a variety of menus, graphic information and document information. The display 1101 has a touch panel formed thereon and acts to input coordinates and items by depressing the surface of the touch panel by the finger or the like. Reference numeral 1102 represents a handset for use when the apparatus acts as a telephone. A keyboard 1103 is detachably connected to the main body of the apparatus so as to input a variety of document information and data. The keyboard 1103 has a variety of function keys 1104. Reference numeral 1105 represents an insertion port through which a floppy disk is inserted into the external storage device 112.

Reference numeral 1106 (see FIG. 12) represents a paper tray on which the document to be read by an image reader portion 107 is placed, the document thus read being discharged from the rear portion of the apparatus. A document received as a facsimile document is recorded by an ink jet printer 1107.

The display portion 102 may be a CRT display. However, it is preferable that a flat panel such as a liquid crystal display utilizing ferromagnetic liquid crystal is employed because the size, thickness and weight can be reduced.

In a case where the above-described information processing apparatus is used as a personal computer or a word processor, a variety of information items input through the keyboard portion 211 is processed by the control portion 101 in accordance with a predetermined program so as to be transmitted as an image from the printer portion 106.

In a case where the apparatus is used as a receiver of a facsimile machine, facsimile information supplied by the FAX transmitting/receiving portion 108 via a communication cable is processed by the control portion 101 in accordance with a predetermined program so as to be transmitted from the printer portion 106 as a received image.

In a case where the apparatus is used as a copying machine, the document is read by the image reader portion 107, read document data being then transmitted to the printer portion 106 via the control portion 101. In a case where it is used as a transmitting device of a facsimile machine, document data read by the image reader portion 107 is processed by the control portion 101 in accordance with a predetermined program so as to be transmitted to the communication cable via the FAX transmitting/receiving portion 108.

Figure 12:
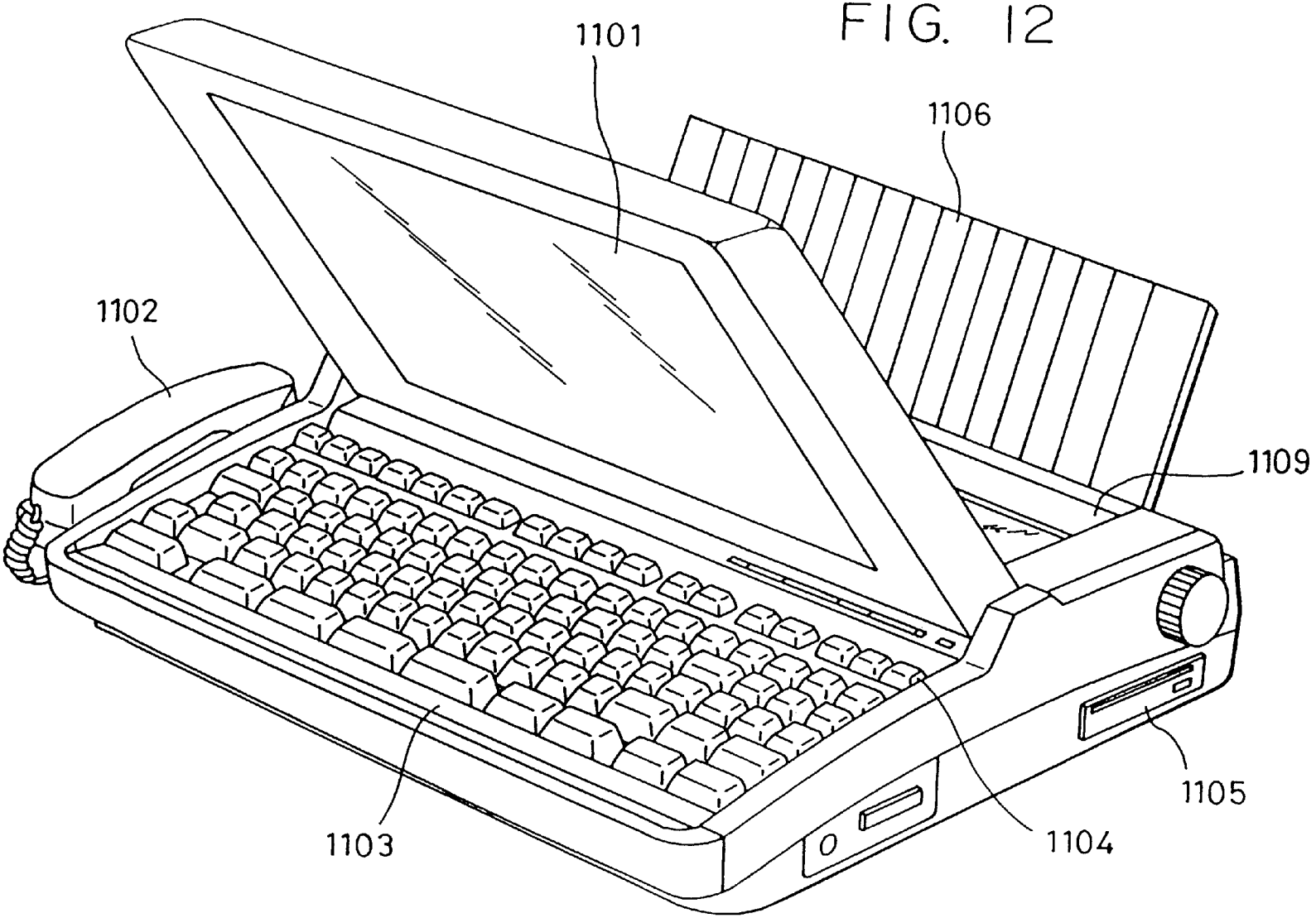
FIG. 12 is a schematic view which illustrates another example of the information processing apparatus shown in FIG. 10.

The above-described information processing apparatus may be arranged to be an integral type as shown in FIG. 12 which includes the ink jet printer. In this case, the portability can further be improved. Referring to FIG. 12, the elements having the same function as those shown in FIG. 11 are given the same reference numerals.

If the recording apparatus is applied to the above-described multi-function information processing apparatus, a recorded image revealing high quality can be obtained at high speed while eliminating noise. Therefore, the performance of the information processing apparatus can further be improved.

As described above, the following effects can be achieved according to the present invention.

(1) Since the number of wiring electrodes to be connected to the electrothermal converting body line is arranged to be larger than the number of the electrothermal converting bodies by one, the electrothermal converting bodies can be successively operated. Therefore, the nozzles of the ink jet recording head can be mounted at high density, for reproducing a precise image. Furthermore, the thickness of the wiring electrode pattern can be enlarged when the electrothermal converting bodies and the wiring electrodes are mounted on the substrate. As a result, the operating currents are not concentrated in a specific wiring electrode. In consequence, the voltage drop across the wiring electrode can be prevented, and unwanted heat generated in the ink jet recording head can be prevented.

(2) Since the deviation of the image signal is not dependent upon the operation for selecting the electrothermal converting body to be activated, the heating value of each of the electrothermal converting bodies can be controlled by changing the width of the image signal during a period in which the selection of the electrothermal converting body is performed. This leads to the fact that undesirable dispersion of the characteristics of the electrothermal converting bodies can be eliminated. In addition, if an ink jet recording head, which is capable of changing the quantity of ink discharged in accordance with the heating value of the electrothermal converting body, is employed, the gradation control of recording a color image can be performed.

(3) Since the direction in which an operating current flows in the wiring electrode and the electrothermal converting body is changed, the process of corrosion due to the electrochemical reaction of the wiring electrode and the electrothermal converting body can be prevented. Therefore, the life of the ink jet recording head can significantly be lengthened. Furthermore, the thickness of the protection layer for preventing the electrochemical reaction can be reduced or omitted from the structure. Therefore, the heat conductivity to the ink can be improved, and the ink discharge can be stabilized. As a result, the reliability of the recording apparatus can be improved. In addition, the ink discharging force can be enlarged since the heat conductivity to the ink is improved. As a result, ink having a relatively high viscosity can be used, causing freedom in selecting the ink to be used. In consequence, an accurate image can be formed.

(4) Since the electrothermal converting body is divided into a plurality of electrothermal converting body groups and an electrothermal converting body is selected from each electrothermal converting body group, a plurality of electrothermal converting bodies can simultaneously be operated. In consequence, the recording speed can be increased.

Although the invention has been described in its preferred form with a certain degree of particularly, it is understood that the present disclosure of the preferred form can been changed in the details of construction and any combination and arrangement of parts may be resorted to without departing from the spirit and the scope of the invention as hereinafter claimed.

What is claimed is:

1. A method of operating an ink jet head for recording by discharging ink in accordance with an image signal, said method comprising the steps of:

providing an ink jet head having a plurality of energy generating elements arranged in a line and a plurality of wiring electrodes which are provided between adjacent energy generating elements and are electrically connected to the adjacent energy generating elements, respectively;

providing a group of high level signals consisting of a plurality of successive high level signals and providing a group of low level signals consisting of a plurality of successive low level signals that are adjacent to the group of high level signals, for selectively operating a plurality of the energy generating elements through a plurality of the wiring electrodes; and operating in sequence the energy generating elements that are disposed between wiring electrodes through which the group of high level signals are applied and wiring electrodes through which the group of low level signals are applied by shifting the group of high level signals and the group of low level signals.

2. A method of operating an ink jet head according to claim 1, further comprising the step of providing a plurality of groups of the high level signals and successive low level signals to simultaneously operate a plurality of the energy generating elements disposed between a plurality of adjacent wiring electrodes.

3. A method of operating an ink jet head according to claim 2, wherein the ink jet head comprises n energy generating elements connected to n+1 wiring electrodes.

4. A method of operating an ink jet head according to claim 3, wherein said operating step comprises applying voltages of different levels corresponding to the image signal to the wiring electrodes connected to selected energy generating elements and applying voltages of equal level to the wiring electrodes connected to remaining energy generating elements.

5. An ink jet apparatus for recording by discharging ink in accordance with an image signal, said apparatus comprising:

an ink jet head having a plurality of energy generating elements arranged in a line and a plurality of wiring electrodes which are provided between adjacent energy generating elements and are electrically connected to the adjacent energy generating elements, respectively; and operating circuits for operating in sequence said energy generating elements that are disposed between wiring electrodes through which a group of high level signals are applied and wiring electrodes through which a group of low level signals are applied, by receiving the group of high level signals consisting of a plurality of successive high level signals and the group of low level signals consisting of a plurality of successive low level signals that are adjacent to the group of high level signals, for selectively operating a plurality of said energy generating elements through a plurality of said wiring electrodes, and by shifting the group of high level signals and the group of low level signals.

6. An ink jet apparatus according to claim 5, wherein said operating circuits, by receiving a plurality of groups of the high level signals and successive low level signals, operate simultaneously a plurality of the energy generating elements disposed between a plurality of adjacent wiring electrodes.

7. An ink jet apparatus according to claim 5, wherein said ink jet head comprises n energy generating elements connected to n+1 wiring electrodes.

8. An ink jet apparatus according to claim 7, wherein said operating circuits apply voltages of different levels corresponding to the image signal to said wiring electrodes connected to said selected energy generating elements and apply voltages of equal level to said wiring electrodes connected to remaining energy generating elements.

* * * * *

UNITED STATES PATENT AND TRADEMARK OFFICE

CERTIFICATE OF CORRECTION

PATENT NO. : 6,056,385

DATED : May 2, 2000

INVENTOR(S) : TAMURA

It is certified that error appears in the above-identified patent and that said Letters Patent is hereby corrected as shown below:

COLUMN 7:
Line 31, the space after "$1_{N+1}$" should be deleted.
Line 32, the space before "is" should be deleted.

COLUMN 8:
Line 22, the space after "$Q_{N+1}$" should be deleted.
Line 23, the space before "from" should be deleted.

COLUMN 12:
Line 39, the space after "$15_{2N}$" should be deleted.
Line 40, the space before "are" should be deleted.

COLUMN 13:
Line 23, the space after "$15_1$,...," should be deleted.
Line 24, the space before "$15_{N-1}$" should be deleted.

COLUMN 17:
Line 23, "with-the" should read --with the--.

COLUMN 21:
Line 41, "deviation" should read --duration--.

UNITED STATES PATENT AND TRADEMARK OFFICE

CERTIFICATE OF CORRECTION

PATENT NO. : 6,056,385

DATED : May 2, 2000

INVENTOR(S) : TAMURA

It is certified that error appears in the above-identified patent and that said Letters Patent is hereby corrected as shown below:

COLUMN 24:

Line 9, "said" should be deleted.

Signed and Sealed this

Tenth Day of April, 2001

*Attest:*

Nicholas P. Godici

NICHOLAS P. GODICI

*Attesting Officer*

*Acting Director of the United States Patent and Trademark Office*